US005402160A

United States Patent [19]

Kadowaki et al.

[11] Patent Number: 5,402,160

[45] Date of Patent: Mar. 28, 1995

[54] INK JET RECORDING APPARATUS WITH PLURAL HEAT PIPES FOR TEMPERATURE STABILIZATION

[75] Inventors: Hidejiro Kadowaki, Yokohama; Ken Tsuchii, Tokyo; Masafumi Wataya, Kawasaki; Toshiyuki Yanaka, Tokyo; Haruhiko Takahashi, Yokohama; Makoto Takamiya, Kawasaki; Kosuke Yamamoto, Yokohama; Yasushi Miura, Kawasaki; Nobuhiko Takekoshi; Hisashi Fukushima, both of Yokohama; Yasushi Murayama, Tokyo; Haruhiko Moriguchi, Yokohama, all of Japan

[73] Assignee: Canon Kabushiki Kaisha, Tokyo, Japan

[21] Appl. No.: 288,702

[22] Filed: Aug. 12, 1994

Related U.S. Application Data

[63] Continuation of Ser. No. 958,458, Oct. 7, 1992, abandoned, which is a continuation of Ser. No. 560,061, Jul. 30, 1990, abandoned.

[30] Foreign Application Priority Data

| | | | |
|---|---|---|---|
| Jul. 28, 1989 | [JP] | Japan | 1-194197 |
| Jul. 28, 1989 | [JP] | Japan | 1-194210 |
| Jul. 28, 1989 | [JP] | Japan | 1-194211 |
| Jul. 28, 1989 | [JP] | Japan | 1-194263 |
| Jul. 28, 1989 | [JP] | Japan | 1-194264 |
| Jul. 28, 1989 | [JP] | Japan | 1-194265 |
| Aug. 31, 1989 | [JP] | Japan | 1-223262 |
| Sep. 19, 1989 | [JP] | Japan | 1-243768 |
| Sep. 19, 1989 | [JP] | Japan | 1-243769 |
| Oct. 20, 1989 | [JP] | Japan | 1-271553 |
| Oct. 20, 1989 | [JP] | Japan | 1-271554 |

[51] Int. Cl.[6] ..... B41J 29/377; B41J 2/05

[52] U.S. Cl. ..... 347/18; 347/42; 165/104.33; 174/15.2; 361/700

[58] Field of Search ..... 347/18, 42; 165/104.33; 361/700; 174/15.2

[56] References Cited

U.S. PATENT DOCUMENTS

| | | | |
|---|---|---|---|
| 3,792,318 | 2/1974 | Fries | 165/104.33 X |
| 4,118,756 | 10/1978 | Nelson | 361/385 |
| 4,120,019 | 10/1978 | Arii | 361/385 |
| 4,296,421 | 10/1981 | Hara | 346/140 |
| 4,313,124 | 1/1982 | Hara . | |
| 4,345,262 | 8/1982 | Shirato et al. . | |
| 4,442,459 | 4/1984 | Fukui | 358/476 |
| 4,459,600 | 7/1984 | Sato et al. . | |
| 4,463,359 | 7/1984 | Ayata et al. . | |
| 4,521,805 | 6/1985 | Ayata | 358/75 |
| 4,558,333 | 12/1985 | Sugitani et al. . | |
| 4,704,620 | 11/1987 | Ichihashi | 346/140 |
| 4,723,129 | 2/1988 | Endo et al. . | |
| 4,740,796 | 4/1988 | Endo et al. . | |
| 4,793,405 | 12/1988 | Diggelmann | 165/104.33 |
| 4,819,011 | 4/1989 | Yokota | 346/76 PH |
| 4,982,274 | 1/1991 | Murase | 357/82 |

FOREIGN PATENT DOCUMENTS

| | | |
|---|---|---|
| 59-123670 | 7/1984 | Japan . |
| 59-138461 | 8/1984 | Japan . |
| 62-55990 | 11/1987 | Japan . |

*Primary Examiner*—Joseph W. Hartary
*Attorney, Agent, or Firm*—Fitzpatrick, Cella, Harper & Scinto

[57] ABSTRACT

An ink jet recording apparatus with plural full-line type recording heads has a heat pipe associated with each recording head. The heat pipes are connected together at a common portion in various ways, such as by a heat-conductive block, one or more additional heat pipes or a container with a heat transferring liquid medium. Such an arrangement enables more efficient and compact temperature control of the recording heads.

9 Claims, 26 Drawing Sheets

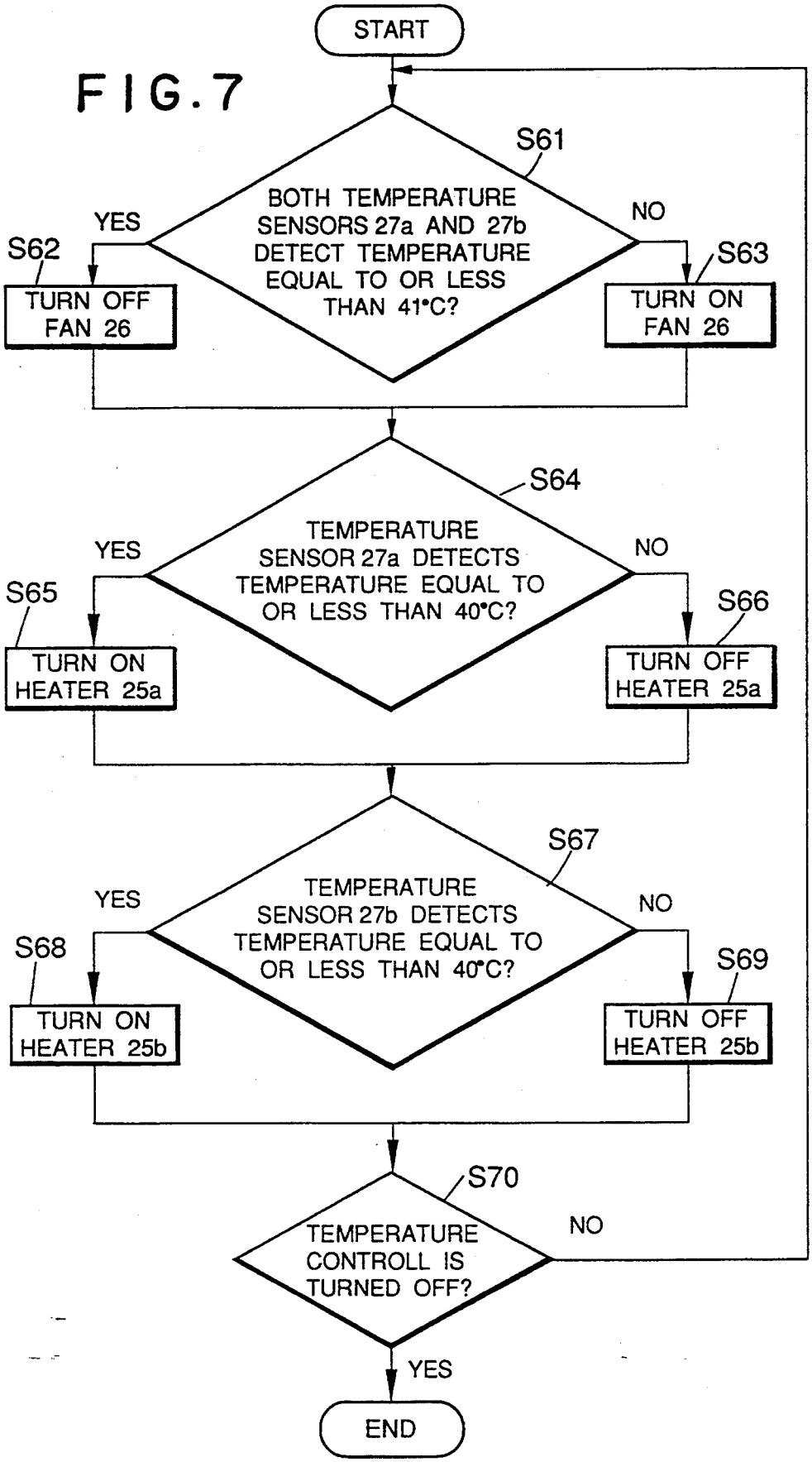
FIG. 7
START
S61
BOTH TEMPERATURE SENSORS 27a AND 27b DETECT TEMPERATURE EQUAL TO OR LESS THAN 41°C?
YES
NO
S62
TURN OFF FAN 26
S63
TURN ON FAN 26
S64
TEMPERATURE SENSOR 27a DETECTS TEMPERATURE EQUAL TO OR LESS THAN 40°C?
YES
NO
S65
TURN ON HEATER 25a
S66
TURN OFF HEATER 25a
S67
TEMPERATURE SENSOR 27b DETECTS TEMPERATURE EQUAL TO OR LESS THAN 40°C?
YES
NO
S68
TURN ON HEATER 25b
S69
TURN OFF HEATER 25b
S70
TEMPERATURE CONTROLL IS TURNED OFF?
NO
YES
END

INK JET RECORDING APPARATUS WITH PLURAL HEAT PIPES FOR TEMPERATURE STABILIZATION

This application is a continuation of application Ser. No. 07/958,458, filed Oct. 7, 1992, now abandoned, and which is a continuation of application Ser. No. 07/560,061, filed Jul. 30, 1990, now abandoned.

BACKGROUND OF THE INVENTION

1. Field of the Invention

The present invention relates an ink jet recording apparatus wherein an image is recorded by discharging ink from an ink discharge port toward a recording medium.

The present invention also relates to a device for controlling a temperature of ink jet recording means, which utilizes a heat exchanging means such as a heat pipe acting as a means for adjusting a temperature of an ink jet recording head.

The present invention is effective for an ink jet recording apparatus, preferably full color ink jet recording apparatus which has one or more recording means of full-line type that can record along a maximum width of a recording medium.

2. Related Background Art

In the past, image recording methods utilizing thermal energy, such as heat sensitive recording methods, heat transfer recording methods or the like have widely been used with facsimiles, copying machines and the like, since they are highly reliable and provide good quality of an images.

Recently, in order to obtain higher recording speed, higher reliability and a better image, interest has been directed to a so-called ink jet recording apparatus wherein a desired image is formed by discharging ink by the use of thermal energy generated in response to a predetermined recording signal.

In such apparatus wherein the desired image is recorded by utilizing thermal energy, in order to achieve the high speed recording, a so-called recording head of full-line type which is designed to record the image by providing a plurality of heating elements along the whole width of a recording medium has been proposed.

If the image is formed (as a solid recording) on a partial area of the recording medium as shown in FIG. 1 by using a recording head of the full-line type, the temperature of a portion of the full-line type recording head which corresponds to the solid recording area will be increased to generate uneven distribution of temperature in the recording head as shown in FIG. 2A(1). Such uneven temperature distribution in the recording head causes overheating of some of the heat generating or heating elements and/or changes in the viscosity of ink, and, for example, if a half-tone recording area is then formed, the image recorded in the half-tone recording area will have the dispersion in density as shown in FIG. 2B(4), thus worsening the quality of the image.

In order to solve the problem regarding the occurrence of such local increase in temperature or uneven distribution of temperature, the some of the inventors have proposed a technique wherein a heat exchanging means such as a heat pipe is attached to an ink jet recording head to improve such problem, as described in U.S. patent application Ser. No. 07/852,333, having an effective filing date of Dec. 28, 1989.

Although such proposed technique wherein the heat pipe is merely attached to the recording head provides a satisfactory temperature adjustment during the recording operation at a low speed, it does not attain the temperature adjustment satisfactorily during the high speed recording operation.

That is to say, in the proposed technique, by attaching the heat pipe to the recording head as mentioned above, the dispersion in temperature as shown in FIG. 2B(4) could be avoided during the low speed recording operation; however, particularly, if the recording of the image was effected on A4 size sheets by utilizing the recording head of full-line type at a high speed (for example, 40 sheets per minute), an adequate temperature adjustment could not be attained.

For example, when the image as shown in FIG. 1 was recorded on 60 sheets continuously by utilizing the recording head including the heat pipe attached thereto, the temperature of a portion of the recording head which corresponds to the solid recording area A was increased up to 50° C. as shown in FIG. 2A(2) even if the temperature of the recording head was adjusted to 40° C. In this case, the recording density in the half-tone recording area created the dispersion in density of 0.10 at the maximum as seen from FIG. 2B(5), thus worsening the quality of the image.

In consideration of the above results, the inventors have proposed a recording head unit wherein both a heat pipe 2 and means for keeping the temperature of the heat pipe 2 even or uniform are associated with a recording head 1 of full-line type. In this arrangement, the recording head 1 has a plurality of orifices disposed along the width of the head and facing toward a recording medium A and further has elements for applying thermal energy to ink supplied to each orifice. Further, in order to balance or equilibrate the temperature through the whole recording head, the heat pipe 2 is provided with heating means 3, heat discharging and cooling means 4, temperature detecting means 5 and the like (which act as means for adjusting the temperature of the heat pipe 2) so that the temperature of the heat pipe is adjusted by selectively activating the heating means 3 or the cooling means 4 through control means 6 on the basis of a detection result from the detecting means 5. Accordingly, the heat exchange between the recording head and the heat pipe (the temperature of which is adjusted) is permitted, thereby providing the even temperature distribution through the whole recording head.

However, in a multi-color recording apparatus, a plurality of such recording head units must be arranged in parallel along the recording medium A. Consequently, the whole apparatus becomes bulky, complicated and expensive. In particular, the heat discharging and cooling means 4 becomes bulky and expensive since it includes heat discharge fins and a blower, with the result that a distance between the adjacent recording head units must be increased. Thus, there arise problems that it is difficult to obtain the registration (coincidence in positions where the colors are superimposed) at high accuracy and the whole apparatus becomes bulky.

In consideration of the above problems, as shown in FIG. 4, in the multi-color recording apparatus, the provision of a common positive heat discharging means 4 including a heat discharging means 17 and a cooling means **4*b* (for cooling the discharging means 17) associated with extension portions 2*a*-1–2*d*-1 of heat pipes 2*a*–2*d* extending outside of the recording area has been proposed. In this arrangement, the heat pipes 2a–2d are associated with the recording heads 1a–1d, respectively, and the heat pipes 2a–2d include heating means 3a–3d and temperature detecting means 5a–5d**, respectively, in the recording area. With this arrangement, since the distance between the recording head units can be reduced, the above registration can be effected conveniently.

However, in this case, if the particular recording head among the recording heads 1a–1d is used continuously (i.e., for example, the recording operation is performed by using only black ink), since the control signal of the cooling means 4b is controlled on the basis of the detected temperature of said recording head, the heat pipes corresponding to the non-used recording heads will also be cooled. Consequently, since the temperature detecting means associated with the non-used recording heads detect the reduction in temperatures of the corresponding recording heads and send the detected signals to the control means 6, the heating means corresponding to the non-used recording heads are also activated, with the result that the colling and the heating are simultaneously effected totally, thus generating the considerable loss of the electric power.

On the other hand, as shown in FIG. 4, in the recording apparatus wherein the plurality of recording heads are arranged in parallel to form a color image, as mentioned above, a distance d between the recording heads is required to be reduced as much as possible within a range that any recording head is not influenced by the adjacent recording head. This requirement is desired in view of the improvement in the above registration (position alignment between the recording head and/or position alignment between the recording areas) and the compactness of the recording system, and, thus, the shorter distance d between the recording heads is preferable. Further, if the color image is recorded by reading the color image, the longer the distance d between the recording heads, the more the memory amount for storing the image data is increased, which leads to increasing cost the recording system. This is also one of the reasons that the distance d between the recording heads must be reduced.

Further, in the recording apparatus wherein the heat pipe is attached to the recording the head, heat conveying capacity of the heat pipe must be considered. That is to say, since the heat conveying capacity of the heat pipe has a certain limitation, in order to obtain the adequate thermal feature, it is necessary to use a heat pipe which can transmit more calories than the maximum calories that can be transmitted from the recording head to the heat pipe or from the heat pipe to the recording head.

The limitation of the heat conveying capacity varies in accordance with a diameter R of the heat pipe, and the larger heat conveying amount is obtained as the diameter of the heat pipe is increased.

Accordingly, in the recording apparatus wherein the plurality of recording heads are arranged as shown in FIG. 4, inconsistent requirements (i.e., the distance d between the recording heads must be reduced, and at the same time the diameters of the heat pipes must be increased) are present.

In order to alleviate such inconsistency, it can be considered that each heat pipe is designed to have a flat configuration as shown in FIG. 4 so that a thickness of the heat pipe is smaller than the distance d between the recording heads. In this case, however, an area of each heat pipe extending outwardly of a contacting area between the heat pipe and the corresponding recording head had the poor heat exchanging ability. That is to say, as shown in FIG. 4, since the whole heat pipe was designed to have the flat configuration, the maximum heat conveying amount of each heat pipe was reduced by 10% in comparison with that of the cylindrical heat pipe. The reason therefor will be derived from the fact that the conveying capacity of the vapor of the operating liquid generated in a heat input area or contacting area between the heat pipe and the corresponding recording head is reduced. Such reduction in the heat conveying capacity causes no problem in the heat input area. However, the heat discharging area is greatly influenced by such reduction in the heat conveying capacity, which results in the reduction in the heat exchanging ability. The reason therefor will be derived from the fact that the vapor of the operating liquid generated in the input area cannot be effectively transmitted to the whole heat discharging area due to the reduction in the heat conveying capacity.

Now, it is considered that heat discharging fins are formed by press fitting a plurality of aluminium plates each having a thickness, for example, of about 0.3 mm, as shown in FIG. 4.

This method is preferable to provide the heat discharging means in the point that surface areas of the whole fins can be increased and the cost is inexpensive. However, when the heat pipes are designed to have the flat configuration, the dispersion will occur in surface shapes of the heat pipes. If such dispersion in the surface shapes is great, it was difficult to fix the fins by the press fit to obtain the stable thermal contacting condition between the heat pipes and the fins.

By the way, from another point of view, an ink jet recording apparatus utilizing a heat pipe is disclosed in the Japanese Patent Publication No. 62-55990. This Publication teaches an arrangement wherein the heat pipe is attached to a recording head of full-line type, for applying the heat generated in the recording head to a recorded recording medium to dry ink on the recording medium. This known technique aims to utilize the waste heat of the recording head, which is quite different from the problem to be solved by the present invention. The heat pipe of this known technique has a uniform cross-section and is designed in an inverted C-shaped configuration for closely contacting with the whole recording area of the recording head to absorb the waste heat from the recording head. Thus, this publication merely teaches the re-use of heat to the recorded image, but does not refer to the above-mentioned problems regarding the recording head itself in the recording process.

SUMMARY OF THE INVENTION

Therefore, an object of the present invention is to provide an ink jet recording apparatus which has a simple construction totally and wherein the heating and cooling are effected regarding all of heat pipes in common, the temperature of recording heads can be performed uniformly and effectively, the ink discharging condition is stable, and the stability of a recorded image is improved. Another object of the present invention is to provide a multi-color ink jet recording apparatus which is devised to reduce the distance between the recording heads and to achieve high heat exchanging efficiency.

A further object of the present invention is to provide an ink jet recording apparatus wherein the air stream from a common blower fan is selectively applied to any one of heat dischargers (radiators) of heat pipes corresponding to recording heads to cool only the heat pipe to be cooled, whereby the temperature gradient due to the heat resistance between the plural recording heads can be corrected to strictly control the temperature of the recording heads and to reduce the above-mentioned loss of the electric power.

A still further object of the present invention is to provide a recording apparatus which can stabilize the recording effected by a plurality of recording heads and obtain a good image.

Other object of the present invention is to provide an ink jet recording apparatus which can uniformly heat recording heads up to desired temperatures for a short time and maintain the temperatures of the recording heads at the desired values uniformly and correctly.

A further object of the present invention is to provide an ink jet recording apparatus which can control the temperatures of the recording heads uniformly and stably.

Other object of the present invention is to provide an ink jet recording apparatus wherein the recording is effected by discharging ink from a plurality of recording heads disposed in parallel toward a predetermined area at a predetermined timing and which is characterized in that first heat pipes juxtaposed to the corresponding recording heads are extended outwardly of recording areas of the recording heads, and second heat pipes are connected to the extended portions of the corresponding first heat pipes at the outside of the recording areas.

Other object of the present invention is to provide an ink jet recording apparatus wherein the recording is effected by discharging ink from a plurality of recording heads toward a recording medium at a predetermined timing and which is characterized in that each of the recording heads has a heat pipe juxtaposed thereto and extending, at its one end, outwardly of a recording area of the corresponding recording head, and the one ends of the heat pipes are attached to a heat-conductive block to be connected to each other.

Other object of the present invention is to provide an ink jet recording apparatus wherein the recording is effected by discharging ink from a plurality of recording heads disposed in parallel toward a predetermined area at a predetermined timing and which is characterized by branch portions juxtaposed to the corresponding recording heads, and a common portion for connecting the branch portions to each other.

Other object of the present invention is to provide an ink jet recording apparatus wherein the recording is effected by discharging ink from a plurality of recording heads disposed in parallel toward a predetermined area at a predetermined timing and which is characterized in that each of the recording heads has a heat pipe juxtaposed thereto and extending, at its one end, outwardly of a recording area of the corresponding recording head, the one ends of the heat pipes being attached to a connecting member for thermally connecting the heat pipes to each other, the connecting member including a cooling means and a plurality of heating means for heating a plurality of portions of the connecting member, a plurality of temperature detecting means being provided in the vicinity of the heating means, for detecting the temperature of the connecting member, and an activation control means being further provided for controlling the activation of the cooling means and the activation of the heating means on the basis of the detected temperature values from the temperature detecting means.

Other object of the present invention is to provide an ink jet recording apparatus wherein the recording is effected by discharging ink from a plurality of recording heads toward a recording medium and which is characterized in that each of the recording heads has a heat pipe mounted thereon and protruding to have a length longer than a recording width of the corresponding recording head, the protruded portion of each heat pipe protruded from the recording head having a heat discharging member attached thereto, and there are provided a single blower fan adapted to apply an air stream to the heat discharging members corresponding to the recording heads, and a plurality of air stream control means adapted to apply the air stream created by the blower fan to the heat discharging members individually or independently.

Other object of the present invention is to provide an ink jet recording apparatus wherein the recording is effected by discharging ink from a plurality of recording heads disposed in parallel toward a predetermined area at a predetermined timing and which is characterized in that each of the recording heads has a heat pipe juxtaposed thereto and extending, at its one end, outwardly of a recording area of the corresponding recording head, the one ends of the heat pipes being attached to a connecting member for thermally connecting the heat pipes to each other, the connecting member having a cooling means including heat discharging fins, a blower fan and an orientation means for deflecting an air stream from the blower fan.

Other object of the present invention is to provide an ink jet recording apparatus wherein the recording is effected by discharging ink from a plurality of recording heads toward a recording medium and which is characterized by heat transmitting members capable of transferring (i.e., giving and receiving) the heat between them and the recording heads, a container accommodating extensions of the heat transmitting members extending from heat transfer areas between the heat transmitting members and the recording heads and including therein heat transferring medium (liquid) for permitting the heat transfer between the heat transmitting members and the recording heads through the extensions, and a control means for controlling the temperature of the heat transferring liquid.

Other object of the present invention is to provide an ink jet recording apparatus wherein an image is formed by flying ink toward a recording medium and which is characterized in that it comprises a recording head having a plurality of electrical/thermal converting elements used for discharging ink, and a heat exchanging means including a first heat exchanging portion contacting with substantially the whole longitudinal area of one side of the recording head for performing the heat exchange between it and the recording head and a second heat exchanging portion spaced from and disposed outwardly of the recording head, and that the first heat exchanging poriton has an elongated rectangular cross-section and the second heat exchanging portion has a circular cross-section.

A further object of the present invention is to provide an ink jet recording apparatus wherein the recording is effected by discharging ink from a plurality of recording heads toward a predetermined area of a recording medium at a predetermined timing and which is characterized in that each of the recording heads is provided with a heat exchanging means including a first heat exchanging portion contacting with substantially the whole longitudinal area of one side of the recording head for performing the heat exchange between it and the recording head and a second heat exchanging portion spaced from and disposed outwardly of the recording head, at least the first heat exchanging portion having an elongated rectangular cross-section, and that, when a shorter side of the elongated rectangular first heat exchanging portion is $d_1$, a distance between the recording heads is d and a distance between a side surface of the first heat exchanging portion of each heat exchanging means and an adjacent side surface of the corresponding recording head is $d_3$, the following relations are satisfied:

| | |
|---|---|
| $5 \leqq d \leqq 20$ mm, | $5 \leqq d_1 \leqq 20$ mm, |
| $0 \leqq d_3 \leqq 15$ mm, | $d > d_1$. |

Other object of the present invention is to provide an ink jet recording apparatus wherein a color image is formed by flying ink toward a recording medium from a plurality of ink jet recording heads of full-line type disposed through the whole width transverse to a moving direction of the recording medium and which is characterized in that it comprises a heat exchanging means including a first heat exchanging portion contacting with substantially the whole longitudinal area of one side of the recording head for performing the heat exchange between it and the recording head and a second heat exchanging portion spaced from and disposed outwardly of the recording head, and that the first heat exchanging portion has an elongated rectangular cross-section and the second heat exchanging portion has a circular cross-section.

Other object of the present invention is to provide a temperature controlling device for an ink jet recording means, which controls the temperature of the ink jet recording means while contacting the latter, and which is characterized by a heat exchanging means including a first heat exchanging portion contacting with the recording means for performing the heat exchange and heat transfer between it and the recording means with respect to an arrangement direction of electrical/thermal converters included in the recording means and having an elongated rectangular cross-section and a second heat exchanging portion spaced from and disposed outwardly of the recording means and having a circular cross-section, and a control means for controlling the temperature of the heat exchanging means, having a heating means for heating the heat exchanging means and a cooling means for colling the heat exchanging means, these heating and cooling means being arranged at an area of the second heat exchanging portion spaced from a recording area of the recording means.

Other object of the present invention is to provide an ink jet recording apparatus wherein an image is formed by flying ink toward a recording medium and which is characterized by an ink jet recording head unit comprising an ink jet recording head having a plurality of electrical/thermal converting elements for discharging ink, a heat exchanging means including a first heat exchanging portion contacting with substantially the whole longitudinal area of one side of the recording head for performing the heat exchange between it and the recording head a second heat exchanging portion spaced from and disposed outwardly of the recording head, a heating means disposed between the first and second heat exchanging portions for heating the heat exchanging means, and a temperature detecting means of contact type disposed in contacting relation to a longitudinal central area of the first heat exchanging portion to detect the temperature of the heat exchanging means; a cooling means acting on the second heat exchanging portion of the heat exchanging means to aid the heat discharge from the second heat exchanging portion; and an activation controlling means for controlling the activation of the cooling means and/or the heating means on the basis of the detected temperature value from the temperature detecting means.

A further object of the present invention is to provide an ink jet recording apparatus wherein a color image is formed by flying ink toward a recording medium from a plurality of ink jet recording heads of full-line type disposed through the whole width transverse to a moving direction of the recording medium and which is characterized by heat exchanging means each including a first heat exchanging portion contacting with substantially the whole longitudinal area of one side of each of the recording heads for performing the heat exchange between it and the corresponding recording head and a second heat exchanging portion spaced from and disposed outwardly of each recording head; heating means each disposed between the first and second heat exchanging portions of each heat exchanging means for heating the corresponding heat exchanging means; temperature detecting means of contact type each disposed in contacting relation to a longitudinal central area of the first heat exchanging portion of each of the heat exchanging means to detect the temperature of the corresponding heat exchanging means; cooling means each acting on the second heat exchanging portion of each of the heat exchanging means to aid the heat discharge from the second heat exchanging portion; and activation controlling means each for controlling the activation of the corresponding cooling means and/or heating means on the basis of the detected temperature value from the corresponding temperature detecting means.

A still further object of the present invention is to provide a temperature controlling device which controls the temperature of the ink jet recording means while contacting the latter and which is characterized by a heat exchanging means contacting with the recording means for performing the heat exchange and heat transfer between it and the recording means with respect to an arrangement direction of electrical/thermal converters included in the recording means, and a control means for controlling the temperature of the heat exchanging means, having a heating means for heating the heat exchanging means and a cooling means for cooling the heat exchanging means, these heating and cooling means being arranged at an end area spaced from a recording area of the recording means.

Other object of the present invention is to provide an ink jet recording apparatus wherein the recording is effected by discharging ink from a recording head toward a recording medium and which is characterized by an ink jet recording head unit comprising a heat pipe having a protruded portion protruding to have a length longer than a recording width of the recording head, a cooling means disposed on the protruded portion for cooling the recording head, and a heating means provided for variably changing the heat amount applied to the recording head through the heat pipe; a temperature detecting means for detecting the temperature of the ink jet recording head unit; and an activation controlling means for controlling the activation of the cooling means and/or heating means on the basis of a detected temperature value from the temperature detecting means.

According to the present invention, since the heat pipes mounted on the plurality of recording heads are integrally connected to each other by using the heat-conductive block, other heat pipes, integral heat pipes or heat transmitting medium, it is possible to perform the heat transfer between the heat pipes, whereby the recording heads and the heat-conductive block can be maintained at the same temperature. Further, since the temperature of the heat-conductive block is detected by the temperature detecting means and the activation controlling means activates the heating means or the cooling mesns on the basis of the detected temperature to heat or cool the heat-conductive block, it is possible to transmit the heat to all of the recording heads uniformly and to control for keeping all of the recording heads at a predetermined uniform temperature.

Furthermore, the loss of the electric power is minimized, the construction becomes simple, the distance between the recording heads can be reduced, and the registration can easily be attained.

In addition, since the temperature of the plural recording heads are controlled through the heat pipes, the temperatures of the recording heads can be controlled totally. Even when the heat amounts of the respective recording heads are different, since the operating fluids can properly move in the heat pipes to discharge the heat, the uniformalization of heat can be achieved.

The heating means or the cooling means are activated on the basis of the connecting member detected by the temperature detecting means, whereby the recording heads are heated or cooled through the connecting member. Since the cooling means has the orientation means to change the direction of the air stream from the blower fan, it is possible to direct the air stream toward the higher temperature area defined by the detected temperature value from the temperature detecting means. Further, since the connecting member thermally connects the heat pipes juxtaposed to the respective recording heads to each other, it is possible to transmit the heat to all of the recording heads uniformly, thereby uniformalizing the temperature of the recording heads.

In the present invention, since the first heat exchanging portion of the heat pipe has the elongated rectangular cross-section, the distance d between the recording heads can be reduced, which results in the cost-down and compactness of the recording apparatus. Further, the heat pipes can easily be attached to the corresponding recording heads.

In addition, according to the present invention, since the second heat exchanging portion of the heat pipe has the circular cross-section, it is possible to effectively transmit the vapor of the operating liquid (generated by the first heat exchanging portion) in the heat pipes to the whole heat discharging area, and, thus, to easily adjust the whole recording head unit at substantially a uniform temperature.

Since the heat pipe to be cooled can be selectively cooled by the action of the control means for controlling the air stream from the fan, the heat discharging operation by means of the heat discharging means and the heating operation by means of the heating means can be prevented from being performed on the same heat pipe, thus eliminating the loss of the electric power.

Furthermore, since the temperature detecting means is disposed in contacting relation to the longitudinal central area of the first heat exchanging portion of the heat exchanging means, wherever the recording heads be positioned, the change in the temperature of the recording heads can be detected through the heat exchanging means at good response.

In addition, since the temperature adjusting means for the recording heads are provided individually and independently when the color recording is effected by using a plurality of recording heads, it is possible to adjust the temperature of the recording heads individually and stably.

Further, since the temperature controlling means for the heat exchanging means is arranged in the end area of the heat exchanging means spaced from the recording area of the recording means (having the heat exchanging means for adjusting the temperature thereof), it is possible to adjust the temperature without affecting the thermal influence upon the recording means, and, even when a plurality of recording means are arranged side by side, since the distance between the recording means can be reduced adequately, it is possible to reduce the production cost of the image and improve the registration accuracy.

In the ink jet recording apparatus according to the present invention, since the heat medium in the heat pipes can be returned, it is possible to control the temperatures of the recording heads uniformly and stably.

Further, by providing the heat means for variably changing the heat amount applied to the recording heads through the heat pipes, the heat can be applied to the recording heads more largely at the start of the recording apparatus so that the recording heads can be quickly warmed up.

When the heat pipes are integrally fixed by the connecting member, the heat transfer between the recording heads can be permitted through the connecting member to effectively utilize the heat in the recording heads, and all of the recording heads can be selectively cooled by a single cooling means.

BRIEF DESCRIPTION OF THE DRAWINGS

FIG. 7 is a flow chart for performing the temperature control of the recording apparatus of FIGS. 5 and 6;

DETAILED DESCRIPTION OF THE PREFERRED EMBODIMENTS

The present invention will now be explained in connection with embodiments thereof with reference to the accompanying drawings.

Figure 5:
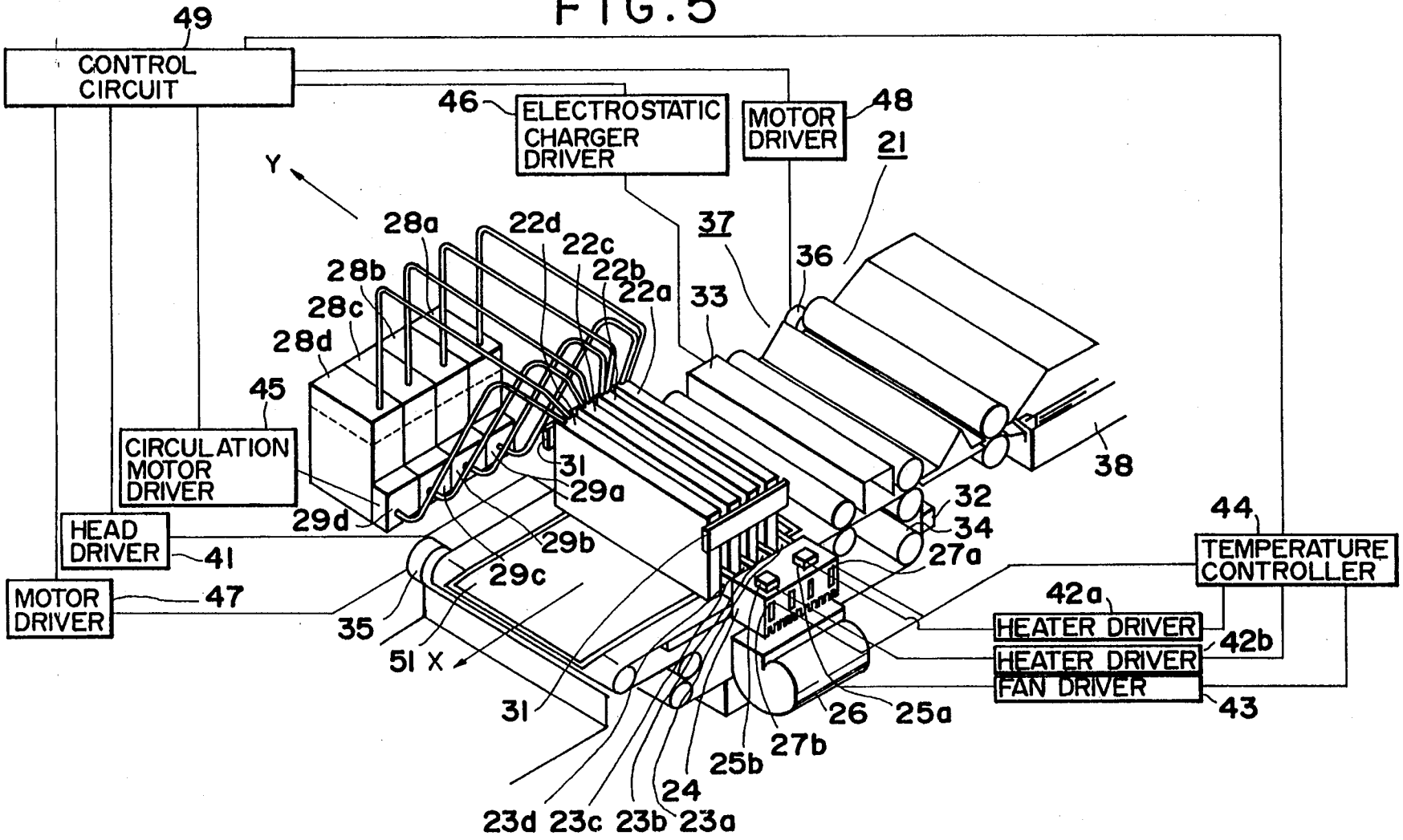
FIG. 5 is a partial perspective view of an ink jet recording apparatus according to an embodiment of the present invention.

FIG. 5 is a schematic perspective view of an ink jet recording apparatus according to a preferred embodiment of the present invention.

Figure 6:
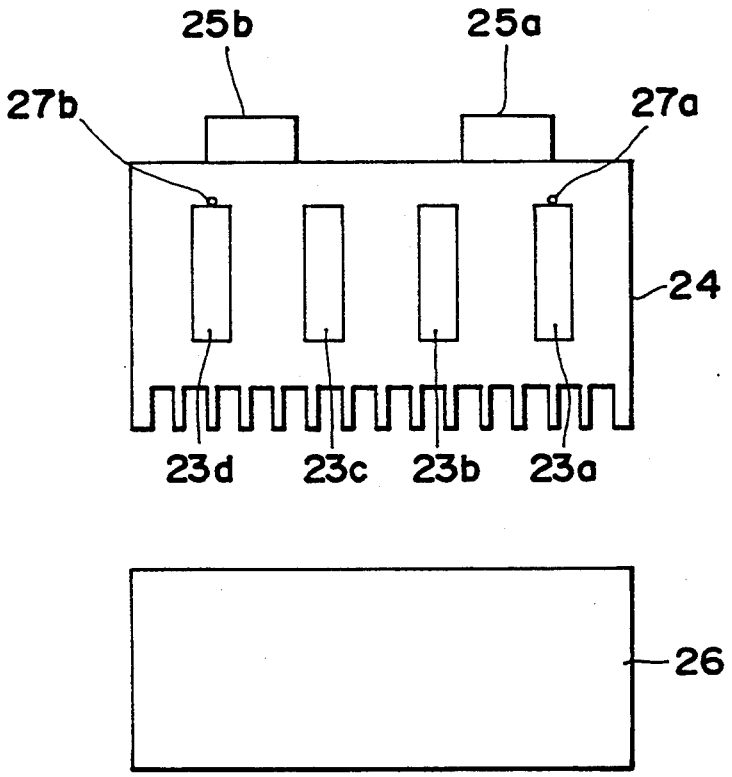
FIG. 6 is a partial side view showing a temperature controlling portion of the recording apparatus according to the embodiment of FIG. 5.

The ink jet recording apparatus 21 shown in FIG. 5 comprises four recording heads 22*a*, 22*b*, 22*c* and 22*d* each being provided at its bottom surface with 3456 nozzles (not shown) arranged at intervals of 16 dots/mm. Each recording head is adapted to record by a length of 216 mm successively per one recording line under a control of a head driver 41. The recording heads 22*a*, 22*b*, 22*c* and 22*d* correspond to ink colors of black, cyan, magenta and yellow, respectively, and are fixedly held and supported by two holders 31 so as to keep a distance between the recording heads in a direction X constant. Heat pipes 23*a*, 23*b*, 23*c* and 23*d* each having a length longer than a longitudinal length of the recording heads 22*a*, 22*b*, 22*c* and 22*d*, respectively, are fixed to the corresponding recording heads in a thermal transferrable relation. The ends of the heat pipes 23*a*, 23*b*, 23*c*, 23*d* directed to a direction Y are aligned with corresponding ends of the recording heads 22*a*, 22*b*, 22*c*, 22*d*, and the other ends of the heat pipes extend outwardly of recording areas of the recording heads. The extensions (extending outside of the recording areas) of the heat pipes 23*a*, 23*b*, 23*c*, 23*d* are connected to each other by a heat discharging block 24 acting as a connecting member. As shown in FIGS. 5 and 6, above the two heat pipes 23*a* and 23*b*, a heater 25*a* acting as a heating means controlled by a heater driver 42*a* is disposed on an upper surface of the heat discharging block 24, whereas, above the remaining heat pipes 23*c* and 23*d*, a heater 25*b* acting as a heating means controlled by a heater driver 42*b* is disposed on an upper surface of the heat discharging block 24. Fins are attached to a bottom surface of the heat discharging block 24. Fins are attached to a bottom surface of the heat discharging block 24, and a fan 26 controlled by a fan driver 43 is arranged below the fins and acts as a cooling means for positively cooling the block 24 by directing an air stream to the fins of the heat discharging block. Further, a temperature sensor 27*a* acting as a temperature detecting means is arranged in the vicinity of the heat pipe 23*a* positioned near one end surface (right end surface in FIG. 6) of the heat discharging block 24, and, similarly, a temperature sensor 27*b* acting as a temperature detecting means is arranged in the vicinity of the heat pipe 23*d* positioned near the other end surface (left end surface in FIG. 6) of the heat discharging block 24. A temperature controller 44 receives information from the temperature sensors 27*a*, 27*b* and activates the heaters 25*a*, 25*b* or the fan 26 through the heater drivers 42*a*, 42*b* or the fan driver 43 on the basis of the received information.

Four ink tanks 28*a*, 28*b*, 28*c* and 28*d* contain therein black ink, cyan ink, magenta ink and yellow ink, respectively, in correspondence to the recording heads 22*a*, 22*b*, 22*c* and 22*d*. These inks are supplied to the corresponding recording heads 22*a*, 22*b*, 22*c* and 22*d* by means of circulation motors (or pumps) 29*a*, 29*b*, 29*c* and 29*d* attached to the ink tanks 28*a*, 28*b*, 28*c* and 28*d*. The circulation motors 29*a*, 29*b*, 29*c*, 29*d* are controlled independently by means of a circulation motor driver 45.

The ink supply from the ink tanks 28*a*, 28*b*, 28*c*, 28*d* to the recording heads 22*a*, 22*b*, 22*c*, 22*d* is effected by the capillary phenomena of nozzles in the recording heads 22*a*, 22*b*, 22*c*, 22*d*, and a head of each ink in each ink tank 28*a*, 28*b*, 28*c*, 28*d* is set to be lower than the orifice surface (not shown) in the recording heads 22*a*, 22*b*, 22*c*, 22*d* by a predetermined level.

A seamless belt (referred to merely as "belt", hereinafter) 34 driven by a motor 35 controlled by a motor driver 47 is adapted to convey a recording medium 51 in the direction X and is provided at its outer surface with high resistive (about $10^{14}$ Ωcm) layer having a thickness of about 50 μm. An inner surface of the belt 34 is earthed. A charger 32 controlled by an electrostatic charger driver 46 charges the outer surface of the belt 34 to +1500 Volts or about. Similarly, a charger 33 controlled by the electrostatic charger driver 46 applies the negative or minus charge to the recording medium 51 so that the recording medium is electrostatically attracted to the surface of the belt 34. A sheet feeding mechanism 37 driven by a motor 36 controlled by a motor driver 48 feeds the recording medium 51 accommodated in a cassette 38 up to a position of the belt 34.

A control circuit 49 systematically controls the operation sequence of the head driver, 41, heater drivers 42*a*, 42*b*, fan driver 43, temperature controller 44, circulation motor driver 45, electrostatic charger driver 46 and motor drivers 47, 48. The heater drivers 42*a*, 42*b*, fan driver 43, temperature controller 44 and control circuit 49 constitute an activation controlling means for selectively activating the heaters 25*a*, 25*b* and the fan 26 on the basis of information from the temperature sensors 27*a* and 27*b*.

Next, the temperature control regarding the recording apparatus according to the illustrated embodiment will be explained. In this case, it is assumed that an upper limit temperature is 41° C. and a lower limit temperature is 40° C.

When a power source is turned ON, after the fundamental operations required to the recording have been performed, the recording operation is started. The fan 26 is not driven immdediately after the power is turned ON and is kept in an OFF condition. On the other hand, both of the heaters 25*a* and 25*b* are turned ON as soon as the power is turned ON, thereby heating the recording heads 22*a*, 22*b*, 22*c*, 22*d* through the heat discharging block 24 and the heat pipes 23*a*, 23*b*, 23*c*, 23*d*. Subsequently, the temperature control will performed in accordance with the following steps.

FIG. 7 shows a flow chart for the temperature control.

First of all, it is judged whether the temperature being detected by the temperature sensors 27*a* and 27*b* are both lower than 41° C. (step S61). If these temperature are below 41° C., the fan 26 is turned OFF (step S62). If at least one of the above temperatures is higher than 41° C., the fan 26 is turned ON (step S63). Next, it is judged whether the temperature being detected by the temperature sensor 27*a* is lower than 40° C. (step S64). If the temperature is below 40° C., the heater 25*a* is turned ON (step S65). If the temperature is higher than 40° C., the heater 25*a* is turned OFF (step S66). Further, it is judged whether the temperature being detected by the temperature sensor 27*b* is lower than 40° C. (step S67). If the temperature is below 40° C., the heater 25*b* is turned ON (step S68). If the temperature is higher than 40° C., the heater 25*b* is turned OFF (step S69).

The above-mentioned temperature control sequence is repeated so long as the command for stopping the temperature control is generated (step S70).

In the normal character printing or recording, since the heat amount emitted from the recording heads 22*a*, 22*b*, 22*c* and 22*d* is a little, the temperatures of the recording heads can be suppressed below 40° C. by the natural cooling of the heat discharging block 24, and, thus, the satisfactory temperature adjustment could be attained by controlling the ON/OFF condition of only the heaters 25*a*, 25*b*. However, when it is desired to record an image, since the heat amount emitted from the recording heads 22*a*, 22*b*, 22*c* and 22*d* is great, it was necessary to adjust the temperature positively or forcibly by using the fan 26.

For example, if the solid recording was effected by using only the recording head 22*a* with discharge frequency of 2 KHz while not performing the heating and cooling operations, the difference in temperature between the recording heads 22*a* and 22*d* became about 5° C. due to the heat resistance of wicked portions (not shown) of the heat pipes 23*a*, 23*b*, 23*c*, 23*d*, heat resistance of the heat discharging block 24 and the difference in the heat resistance between the heat pipes 23*a*, 23*b*, 23*c*, 23*d* and the heat discharging block 24 and the like. Thus, it was necessary to cool the recording head 22*a* and to heat the recording head 22*d*. Under the circumstances, by performing the temperature control in accordance with the sequence through the steps S61–S70, the above difference in temperature could be corrected and it was possible to obtain the image of high quality with stabilization of the discharge of ink and the fixed diameter of each dot without increasing the distance between the recording heads.

In the illustrated embodiment, while two temperature sensors and two heaters were used, each of these elements may be one, or three or more. Incidentally, it should be understood that, as the numbers of these elements are increased, the dispersion in temperature between the recording heads can be corrected more finely. Further, a plurality of fans for directing the air stream to the fins may be provided so that only the fan corresponding to the heated recording head can be driven, whereby the dispersion in temperature between the recording heads can be corrected more positively.

According to the illustrated embodiment, since the temperatures of the recording heads can be controlled uniformly and stably along the longitudinal direction thereof, the discharge condition of ink is greatly stabilized, thereby improving the stability of the image. Further, since the cooling means is disposed at the areas of the heat pipes extending outwardly of the recording areas, the flying ink discharged from the recording head in the recording area is not disturbed.

In addition, since the temperature of the plurality of recording heads can be controlled uniformly and stably by fixing the heat pipes by means of the connecting member thermally connecting the pipes to each other, the disorder in the recorded characters can be prevented. Further, the temperatures of all of the recording heads can be controlled by a single cooling means.

Furthermore, the temperatures of the recording heads can be detected with high accuracy, whereby the temperatures of the recording heads can be controlled more stably.

Figure 8:
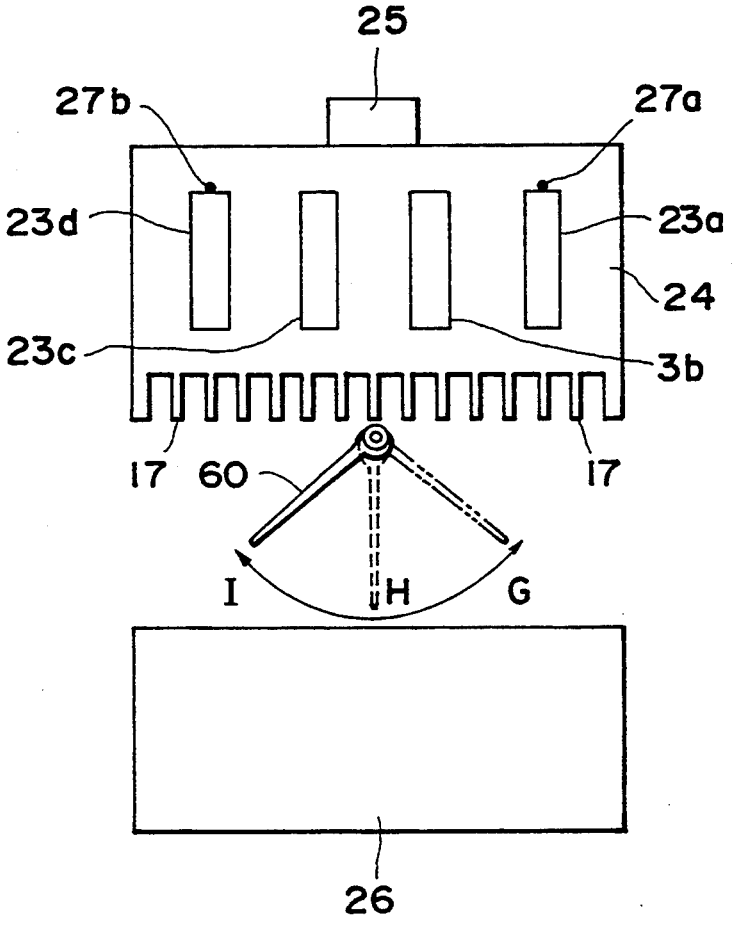
FIG. 8 is a partial side view showing a temperature controlling portion of a recording apparatus according to another embodiment of the present invention.

Incidentally, an example of the arrangement that the cooling is effectively performed by using a single fan is shown in FIG. 8. In this example, the fan 26 controlled by the fan driver 43 and a deflection or orientation wing 60 controlled by an orientation wing driver are disposed below the heat discharging block 24, so that the heat discharging block 24 can be forcibly cooled totally or partially by changing the direction of the air stream from the fan 26 to the fins of the heat discharging block 24. The temperature controller 44 receives information from the temperature sensors 27*a*, 27*b* and controls for selectively activating the heater 25 or the fan 26 and the orientation wing 60 through the heater driver 42 or the fan driver 43 and the orientation wing driver on the basis of the received information.

Next, the temperature control regarding the recording apparatus according to this embodiment will be explained. In this case, it is assumed that an upper limit temperature is 41° C. and a lower limit temperature is 40° C.

When a power source is turned ON, after the fundamental operations required for recording have been performed, the recording operation is started. The fan 26 is not driven immediately after the power is turned ON and is kept in an OFF condition. On the other hand, the heater 25 is turned ON as soon as the power is turned ON, thereby heating the recording heads 22*a*, 22*b*, 22*c*, 22*d* through the heat discharging block 24 and the heat pipes 23*a*, 23*b*, 23*c*, 23*d*. Subsequently, the temperature control will performed in accordance with the following steps.

This temperature control will be described with reference to FIG. 9.

First of all, after the power source has been turned ON, it is judged whether the temperatures being detected by the temperature sensors 27*a* and 27*b* are both higher than 40° C. (step S301). If these temperatures are above 40° C., the heater 25 is turned OFF (step S302). Next, it is judged whether the temperatures being detected by the temperature sensor 27*a*, 27*b* are lower than 41° C. (step S304). If the temperatures are below 41° C., the fan 26 is turned ON (step S305) and the orientation wing 60 is set to a position H shown in FIG. 8 (step S307). In the step S304, if at least one of the temperature sensors 27*a*, 27*b* detects the temperature higher than 41° C., the fan 26 is turned ON (step S306), and, in this condition, it is judged whether the temperature sensor 27*a* detects the temperature higher than 41° C. (step S308). If the temperature sensor 27*a* does not detect the temperature higher than 41° C., since the other sensor 27*b* detects the temperature higher than 41° C., it is necessary to cool the element detected by the temperature sensor 27*b*. Accordingly, in this case, the orientation wing 60 is set to a position G in FIG. 8 (step S310).

On the other hand, in the step S308, if the temperature sensor 27*a* detects the temperature higher than 41° C., then it is judged whether the other temperature sensor 27*b* detects the temperature higher than 41° C. (step S309). As a result, if the temperture sensor 27*b* does not detect the temperature higher than 41° C., since only the temperature sensor 27*a* detects the temperature higher than 41° C., it is necessary to cool the element detected by the temperature sensor 27*a*. Accordingly, in this case, the orientation wing 60 is set to a position I in FIG. 8 (step S311). Whereas, if the temperature sensor 27*b* also detects the temperature higher than 41° C., since both of the sensors 27*a* and 27*b* detect the temperature higher than 41° C., the orientation wing 60 is set to the position H shown in FIG. 8 to cool the whole heat discharging block 24 (step S307).

On the other hand, in the step S301, if at least one of the temperature sensors 27*a* and 27*b* detects the temperature lower than 40° C., the heater 25 is turned ON (step S303), and, in this condition, the above-mentioned step S304 and subsequent steps are repeated. In this case, when both of the temperature sensors 27*a*, 27*b* detect the temperature lower than 40° C. and when only one of these sensors detects the temperature lower than 40° C. and the other sensor detects the temperature higher than 40° C. and lower than 41° C., only the heating by means of the heater 25 is effected; whereas, when one of the temperature sensors 27*a*, 27*b* detects the temperature lower than 40° C. and the other temperature sensor detects the temperature higher than 41° C., the heating by means of the heater 25 is effected, and at the same time, the orientation wing 60 is set to the position G or I in FIG. 8 to cool the element detected by the temperature sensor detecting the temperature higher than 41° C. by the fan 26.

The above-mentioned temperature control sequence is repeated so long as the command for stopping the temperature control is generated (step S312).

Figure 10:
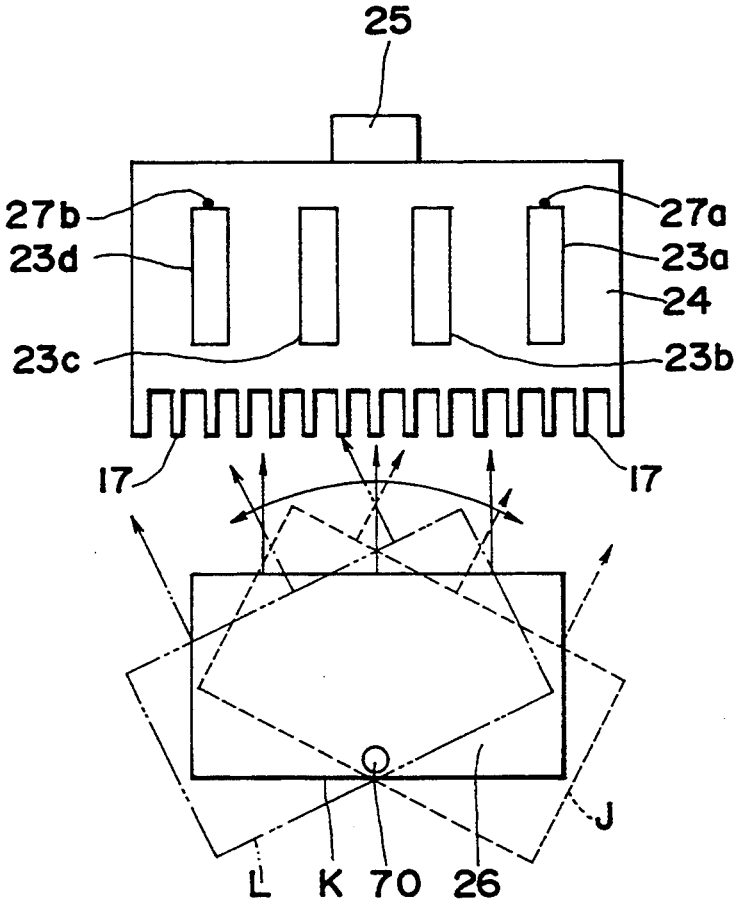
FIG. 10 is a partial side view showing a temperature controlling portion according to further embodiment.

Incidentally, as shown in FIG. 10, the fan 26 acting as the cooling means may be pivotally mounted for rocking movement around a pivot 70, and the activation of the fan 26 including the rocking movement thereof may be controlled by a temperature controller through the fan driver 43. Also in this case, the same advantage as that mentioned above can be obtained.

According to the illustrated embodiment, since the connecting member can be partially or totally cooled or the whole heating can be selectively controlled on the basis of the information given from the plural temperature detecting means for detecting the temperature of the connecting member, the gradient in temperature due to the difference in heat resistances between the recording heads can be corrected, thereby strictly controlling the temperatures of the recording heads. Thus, it is possible to stabilize the ink discharge feature and the diameters of the dots, thereby permitting the recording with high quality.

Further, since the cooling means is constituted by only the single fan and the direction of the air stream from the fan can be changed to effectively cool the connecting member, the whole recording apparatus can be compact and inexpensive and the power consumption can be reduced.

Figure 11:
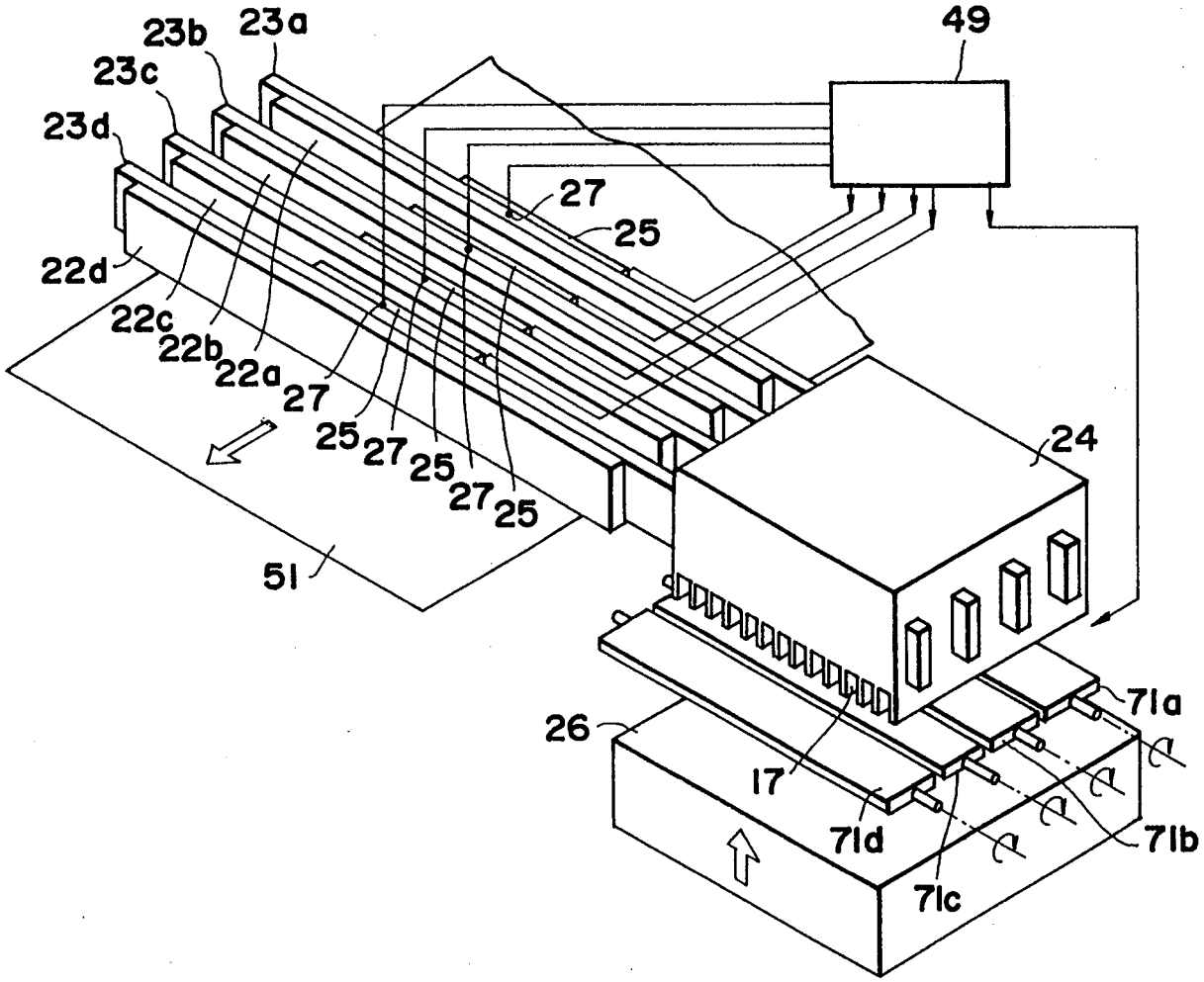
FIG. 11 is a partial perspective view of an ink jet recording apparatus according to a further embodiment of the present invention.

Further, the temperature adjustment may be effected by providing a plurality of plate-shaped air stream controlling means (corresponding to the number of the recording heads) between the heat discharging fins and the blower fan. That is to say, as shown in FIG. 11, a common fan 26 is arranged below fins 17 attached to the heat pipes 23 in the areas of the latter protruding outwardly of the recording areas of the recording heads. Further, between the blower fan 26 and the heat discharging fins 17, blades 71 acting as the plate-shaped air stream controlling means are pivotally mounted on pivot shafts in correspondence to the heat pipes. By providing small motors such as stepping motors in association with the pivot shafts, these blades can be rotated independently in response to a control signal from a apparatus controller (activation controlling means) 49.

According to the illustrated embodiment, since the air stream controlling means is provided, it is possible to direct the air stream from the single common blower to the heat discharging members (fins) of any of heat pipes corresponding to a desired recording head, and, thus to cool only the heat pipe to be cooled, thereby minimizing the loss of the electric power. Further, since the blower fan can be used in common, the registration can advantageously be achieved, and the whole apparatus can be small-sized.

Figure 12:
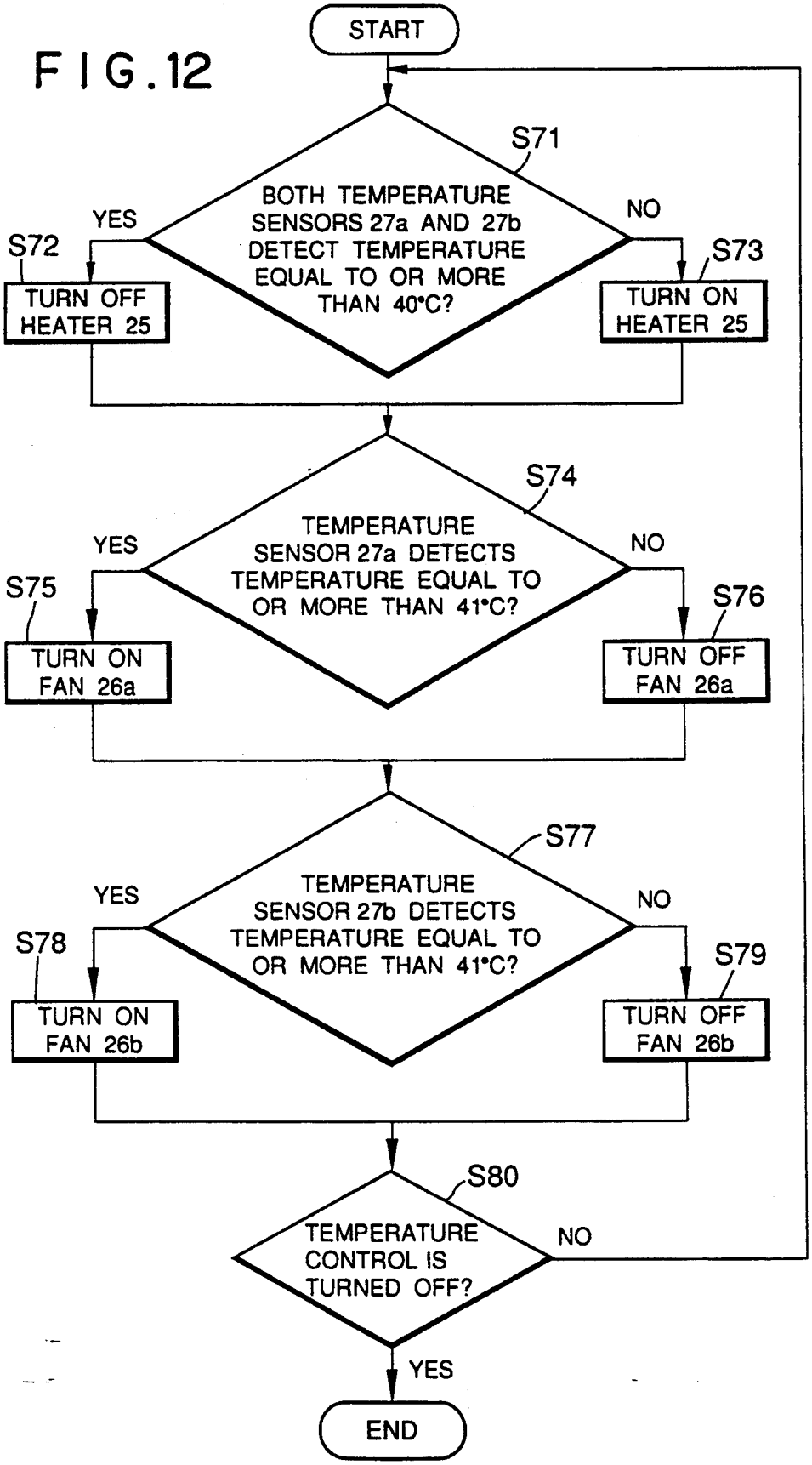
FIGS. 12 and 13 are flow charts for performing the temperature control.

Next, the temperature control when two temperature sensors, a single heater and two fans are used will be explained with reference to FIG. 12.

First of all, after the power source has been turned ON, it is judged whether the temperatures being detected by the temperature sensors 27*a* and 27*b* are both higher than 40° C. (step S71). If these temperatures are above 40° C., the heater 25 is turned OFF (step S72). Next, it is judged whether the temperature being detected by the temperature sensor 27*a* is higher than 41° C. (step S74). If the temperature is higher than 41° C., one of the fan 26*a* is turned ON (step S75), and if the temperature does not reach 41° C., the fan 26a is turned OFF (step S76). Further, it is judged whether the temperature being detected by the temperature sensor 27b is higher than 41° C. (step S77). If the temperature is higher than 41° C., the other fan 26b is turned ON (step S78), and if the temperature does not reach 41° C., the fan 26b is turned OFF (step S79). On the other hand, in the step S71, if the temperature being detected by at least one of the temperature sensors 27a, 27b is lower than 40° C., the heater 25b is turned ON (step S73), and, at that condition, it is judged whether the temperature being detected by the temperature sensor 27a is higher than 41° C. (step S74). As a result, if the temperature is higher than 41° C., the fan 26a is turned ON (step S75), whereas, if it does not reach 41° C., the fan 26a is turned OFF (step S76). Further, it is judged whether the temperature being detected by the other temperature sensor 27b is higher than 41° C. (step S77). If the temperature is higher than 41° C., the other fan 26b is turned ON (step S78), and if the temperature does not reach 41° C., the fan 26b is turned OFF (step S79).

The above-mentioned temperature control sequence is repeated so long as the command for stopping the temperature control is generated (step S80).

According to the illustrated embodiment, by selectively controlling the cooling or the heating of the connecting member on the basis of the information given from the plural temperature detecting means for detecting the temperature of the connecting member, the gradient in temperature due to the difference in heat resistances between the recording heads can be corrected, thereby strictly controlling the temperatures of the recording heads. Thus, it is possible to stabilize the ink discharge feature and the diameters of the dots, thereby permitting the recording with high quality.

Further, since the plurality of cooling means are provided and the connecting member is made of material having good heat-conductivity, even if one of the cooling means is damaged, the connecting member can be cooled by the other normal cooling means.

Figure 13:
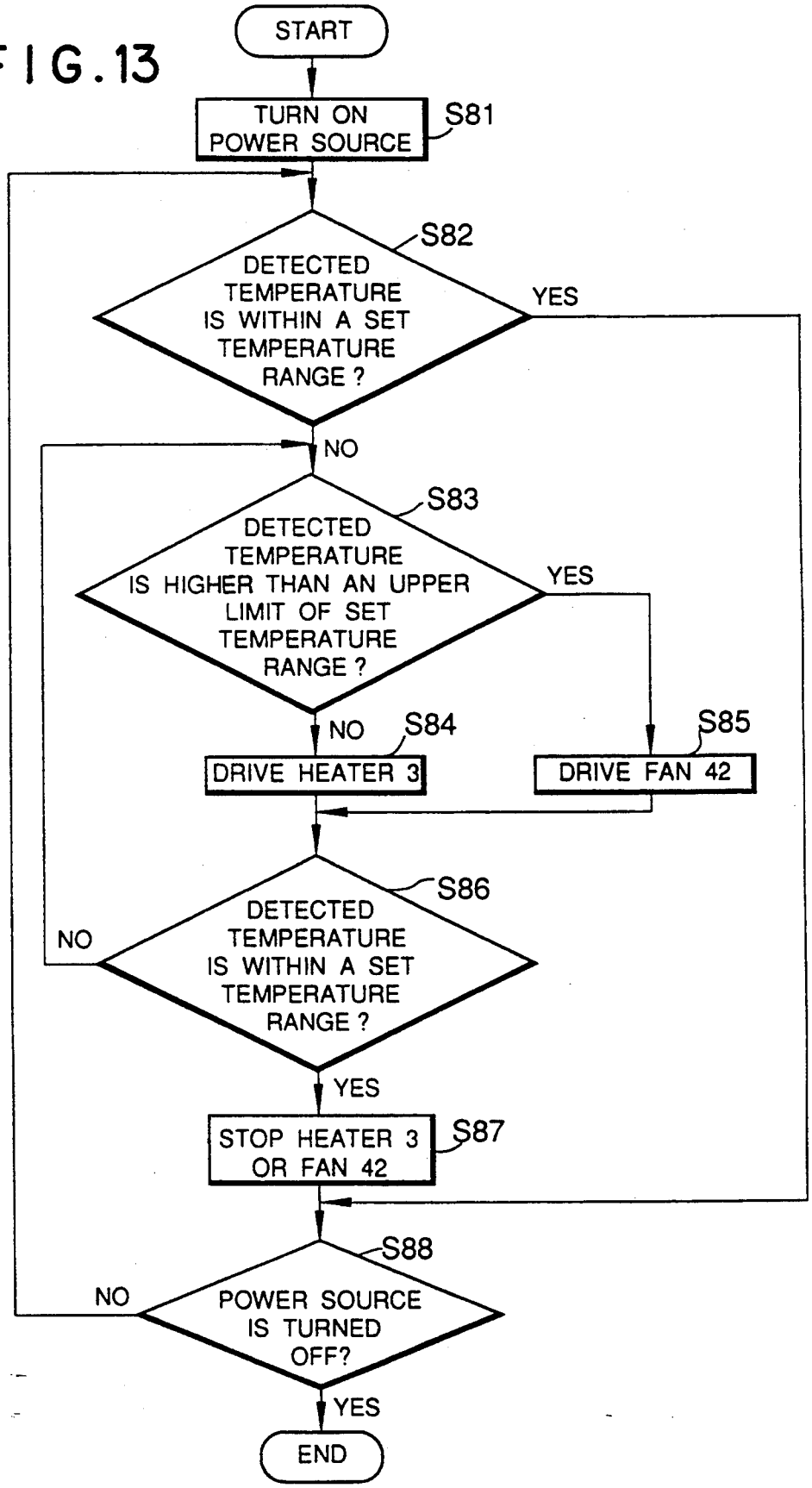

Next, the temperature control when a single temperature sensor, a single heater and a single fan are used will be epxlained with reference to FIG. 13.

First of all, when the power source is turned ON (step S81), it is judged whether the temperature detected by the temperature sensor 27 is included within a set temperature range (step S82). If the detected temperature is within the set temperature range, the same judgements are repeated every predetermined time periods until the power source is turned OFF. On the other hand, if the detected temperature is out of the set temperature range, it is judged whether the detected temperature is higher than a temperature corresponding to an upper limit of the set range (step S83). If higher, the fan 26 is activated to cool the heat discharging block 24 (step S84); whereas, if lower, since the detected temperature is lower than the temperatures in the set range, the heater 25 is activated to heat the heat discharging block 24 (step S85). While the heat discharging block 24 is being cooled or heated by the blower fan 26 or the heater 25, it is still being judged whether the detected temperature is included in the set temperature range (step S86), and, if the detected temperature is increased or decreased out of the set range, the step S83 and the subsequent steps are repeated, whereas, if the detected temperature is within the set temperature range, the heater 25 or the blower fan 26 is stopped. Thereafter, the step S82 and the subsequent steps are repeated until the power source is turned OFF (step S88), thereby maintaining the temperatures of the recording heads of line type 22a, 22b, 22c, 22d within the set temperature range.

For example, if only the recording head of line type 22a is frequently used so that the temperature thereof is increased, the temperature of the recording head 22a is dispersedly transmitted to the other recording heads of line type 22b, 22c, 22d uniformly through the heat pipes 23a, 23b, 23c, 23d. Thus, the increase or decrease in temperature of any specific recording head can be prevented. Further, as a result that the temperature of the heated recording head 22a is dispersedly transmitted to the other recording head, if the temperature detected by the temperature sensor 27 is increased higher than the set temperature range, the controller 44 activates the blower fan 26 to cool the heat-conductive block 24 so that the temperature of the heat-conductive block 24 is lowered within the set temperture range, whereby the temperatures of the recording heads 22a, 22b, 22c and 22d are also returned within the set temperature range.

Incidentally, generally, in the recording of the color image, when three color ink are to be discharged simultaneously, since they are replaced by the black ink by UCR treatment, three recording heads of line type are almost not used simultaneously; thus, the heat discharging means 4 may be designed to have the cooling ability in consideration of the increase in temperature regarding the total ink discharge of three or less recording heads of line type.

As mentioned above, according to the illustrated embodiment, since the heat pipes mounted on the corresponding recording heads are connected to the heat-conductive block to permit the heat transfer between the recording heads, the following advantages can be obtained.

That is to say, it is possible to perform the temperature control of the recording heads only by a single temperature detecting means, a single heating means and a single heat discharging means, thus making the recording apparatus small-sized and inexpensive.

Further, the loss of the electric power due to the heat discharge can be prevented, and, thus, it is possible to perform the heating and the heat discharging efficiently.

Further, the cooling ability of the heat discharging means can be set to have a lower value, thus permitting the compactness of the heat discharging means.

In addition, since the distance between the recording heads can be reduced, the registration can be achieved advantageously.

In the above, the arrangement wherein the plurality of heat pipes are connected to each other through the heat-conductive block was explained. With this arrangement, it is possible to adjust the temperatures of the plurality of recording heads uniformly; however, a unique connection of heat pipes capable of providing more uniform temperature adjustment will now be explained hereinbelow.

Figure 14:
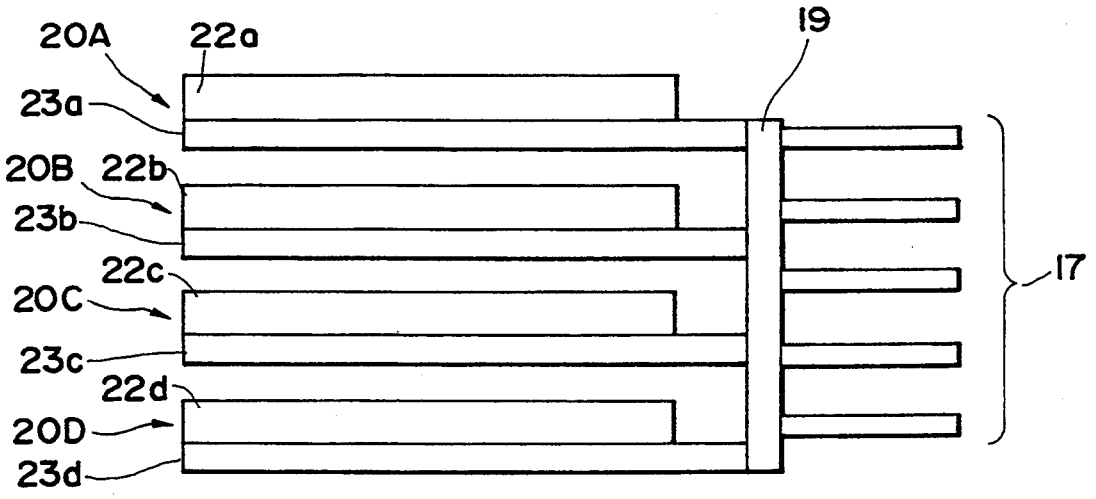
FIG. 14 is a schematic constructural view showing an example of recording heads and heat transmitting means according to the present invention.

FIG. 14 shows an example of a full color recording head block (referred to merely as "color recording head" hereinafter) comprising a plurality (four in this embodiment) of recording head units, according to the present invention. The reference numerals 20A, 20B, 20C and 20D denote recording head units for cyan ink, magenta ink, yellow ink and black ink, respectively; 23a, 23b, 23c, 23d denote heat pipes as heat exchanging means provided as part of the corresponding recording head unit; 19 denotes a common heat-conductive member for connecting one ends of these heat pipes 23*a*–23*d*; and 17 denotes a plurality (five in this embodiment) of heat discharging fins attached to the common heat-conductive member 19. Incidentally, although not shown in the drawings, the common heat-conductive member 19 has an appropriate heating means. Further, the heat pipes 23*a*–23*d* and the common heat-conductive member 19 may be good heat-conductive material such as aluminium; particularly, since the aluminium has greatly high heat-conductivity larger than that of copper by several tens to several hundreds times, these elements were made of aluminium in this embodiment.

Incidentally, in the illustrated embodiment, each recording head comprised a multi-type recording head having 256,400 dpi nozzles to perform the recording of full-color image. In this case, the temperatures of the recording head units 20A–20D were adjusted to 45° C. under the control of a heating means such as posister and a cooling means such as a fan. Incidentally, the fan had a maximum wind velocity of 2 m/sec to adjust the temperatures of the recording heads to 45° C.±5° C. through five fins 17 (each having a dimension of 40 mm×40 mm, a distance therebetween being 10 mm), thereby obtaining a good recorded image without dispersion in density due to the temperature distribution in each recording head and between the recording heads.

In the recording apparatus so constructed, it was ascertained that the cooling ability thereof might be greatly less than when the recording heads constituted by the recording units each having fins were used. The main reason is that, in the ordinary full-color image recording, four recording head units are not driven simultaneously because the simultaneous recording can be effected by 2–2.7 colors at the most due to UCR (under color removal), and, accordingly, the cooling ability required to discharge the heat generated by activating 2–2.7 recording heads simultaneously is merely requested.

Figure 15:
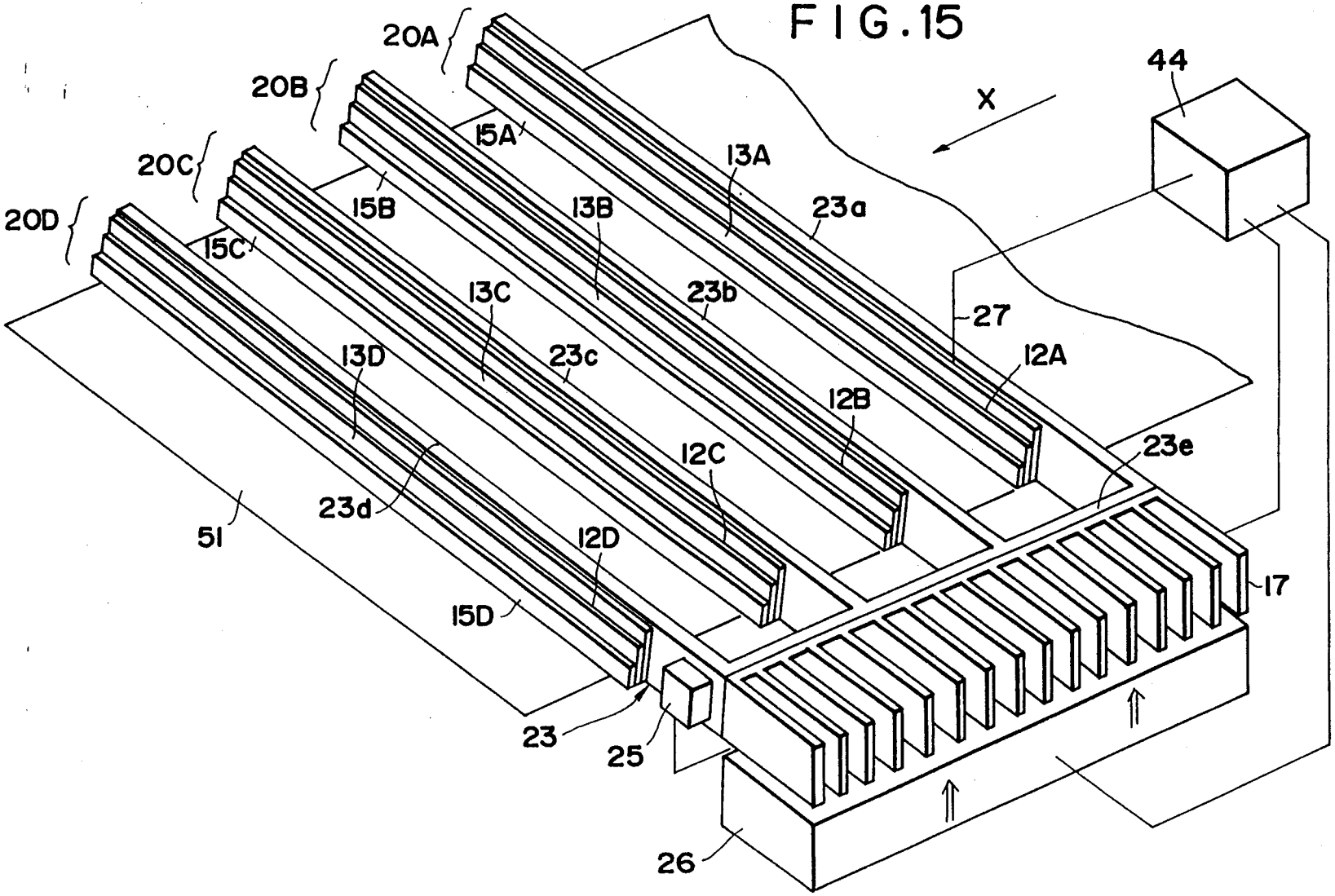
FIGS. 15 to 17 are perspective views of ink jet recording apparatuses according to other embodiments of the present invention.

Next, a further embodiment of the present invention will be explained with reference to FIG. 15.

In this embodiment, a comb-shaped heat pipe 23 is used, which heat pipe comprises plate-like heat pipe portions (referred to as "branched portions" hereinafter) 23*a*–23*d* branched from a base portion (common heat-transmitting portion) 23*e* and extending along support members 12A–12D for the corresponding recording units 20A–20D, the branched portions being connected to the corresponding support members. The substantial construction of this embodiment is similar to that shown in FIG. 14.

In the illustrated embodiment, the recording is performed by discharging the ink of different color from the ink discharge opening of each recording head while shifting the recording medium 51 with respect to the recording head units 20A–20D in a direction X. At the same time, on the basis of a detected temperature from a temperature sensor 27 mounted between one support member 12A and the heat pipe branched portion 23*a*, the controller 44 controls to keep the temperature of the support member 12A at a predetermined value by selectively activating or deactivating the fan 26 and the heater 25. Also in this embodiment, similar to the previous embodiments, it is possible to control for maintaining the temperatures of the support members 12A–12D for the recording head units 20A–20D at substantially the same value.

Figure 16:
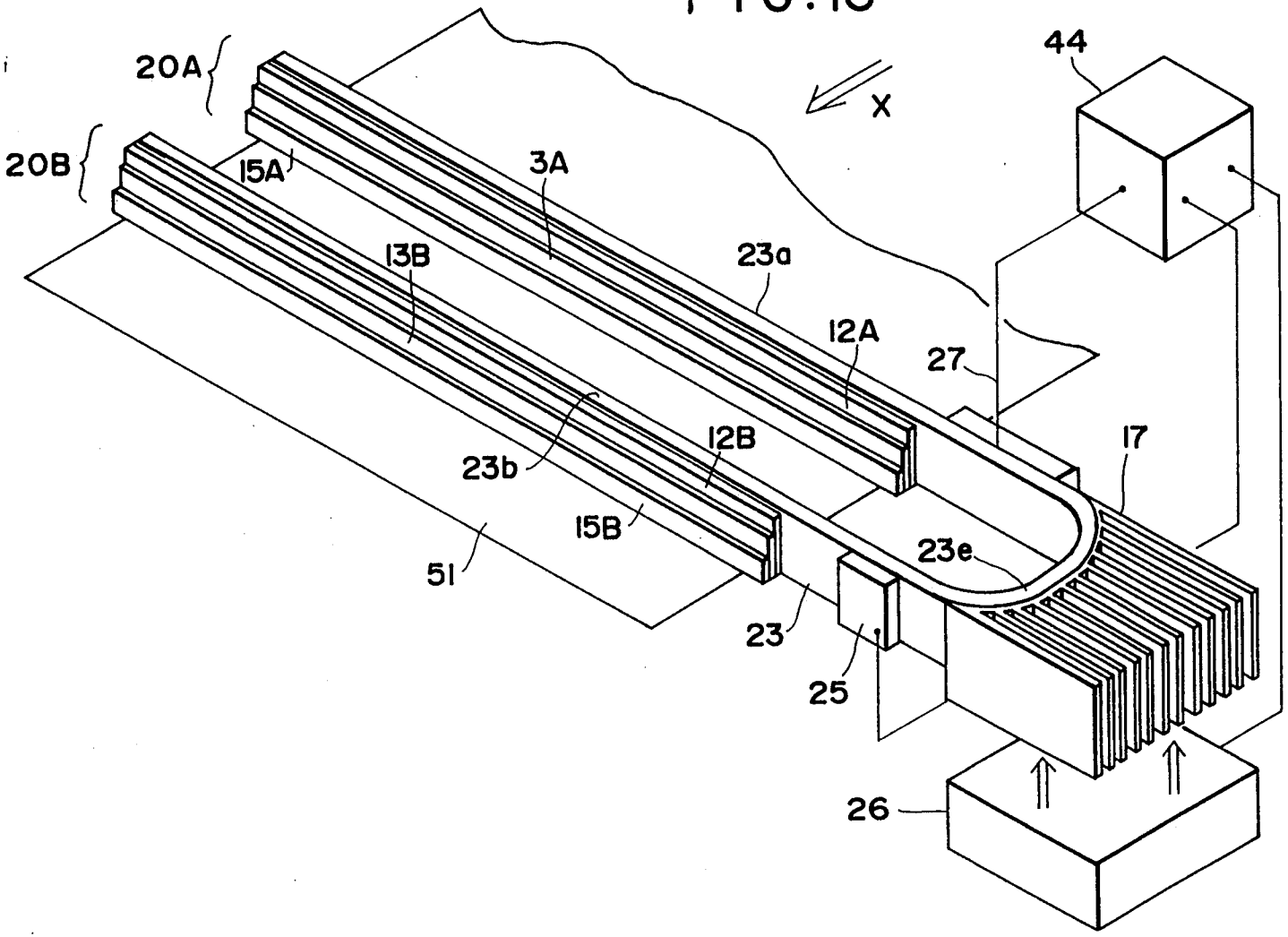

FIG. 16 shows a still further embodiment of the present invention. This embodiment is applied to two recording head units 20A and 20B arranged in parallel. In this embodiment, a heat pipe 23 is formed in a U-shaped configuration, where a base of U is used as a common portion 23*e* and two legs of U are used as branched portions 23*a* and 23*b* extending along and fixed to the support members 12A and 12B for the recording head units 20A and 20B.

Incidentally, since the temperature control of the recording head units of this embodiment during the recording operation is similar to that of the previous embodiment, the explanation thereof will be omitted.

Figure 17:
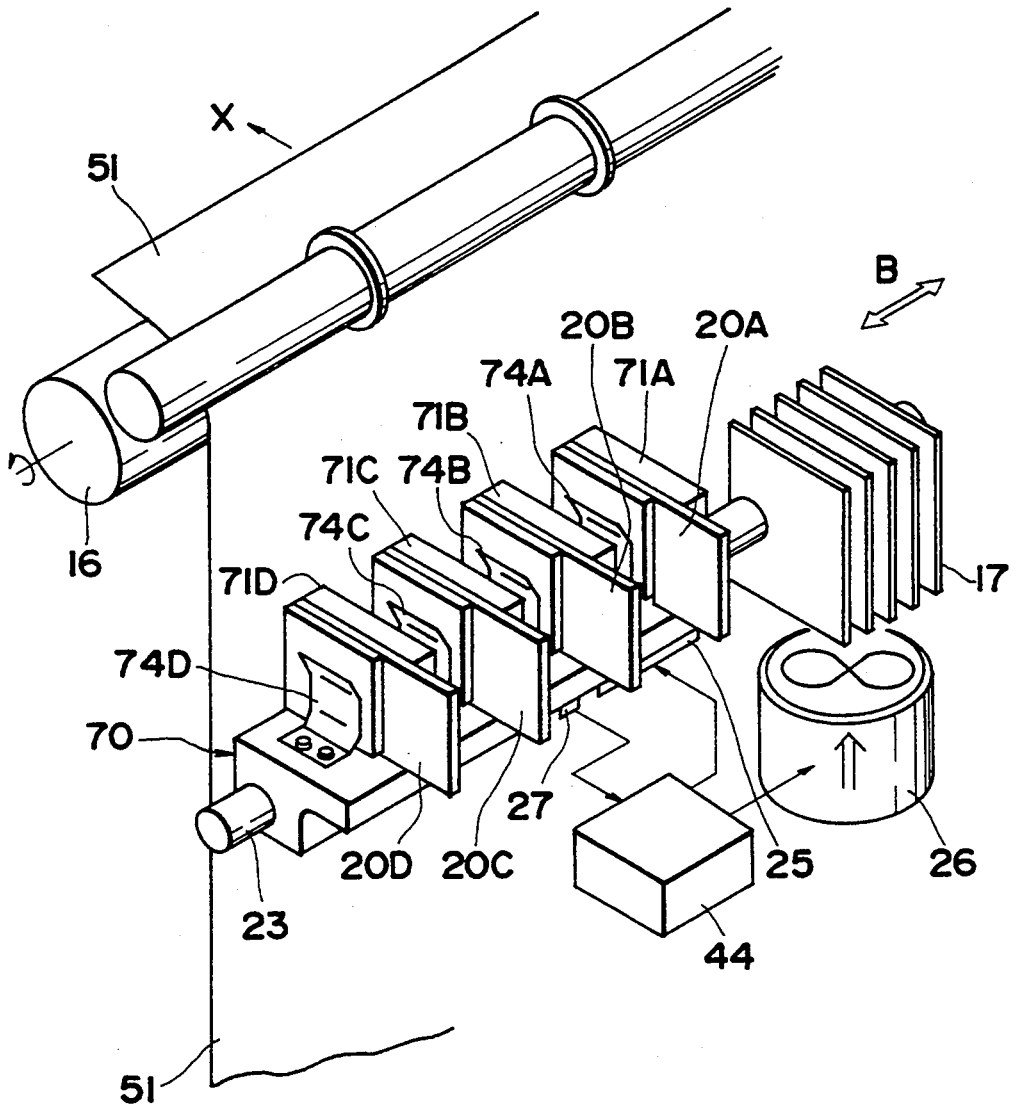
Figure 18:
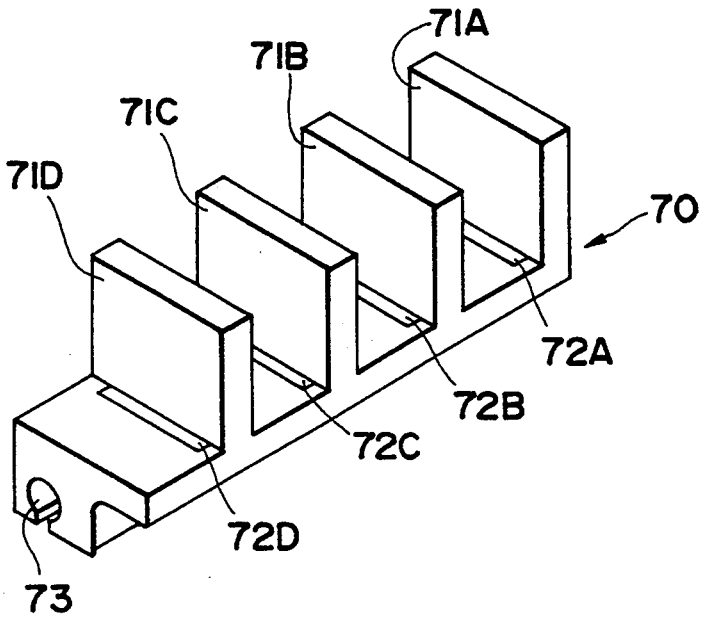
FIGS. 18 and 19 are views showing respectively a heat transmitting block and a heat pipe according to a further embodiment.
Figure 19:
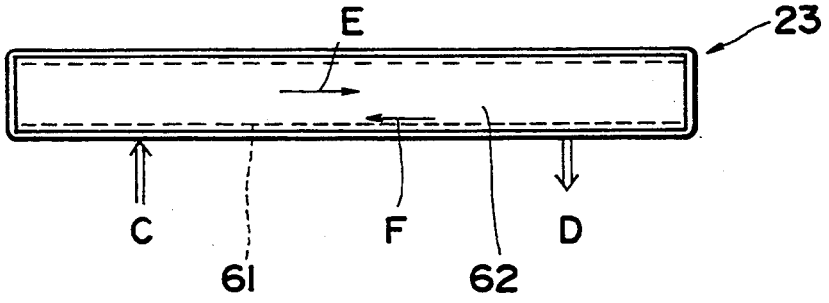

FIGS. 17 to 19 show a further embodiment of the present invention. In this embodiment, the heat transfer between a single heat pipe and a plurality of recording heads is permitted through a block having good heat-conductivity to uniformalize the temperatures of the recording heads and to maintain the temperatures of the recording heads at a predetermined value during the recording operation by heating or cooling the heat pipe.

FIG. 18 shows a construction of the heat-conductive block for holding the recording heads and acting as a heat transmitting medium. The heat-conductive block 70 is made of good heat-conductive material such as aluminium, copper or heat pipe and is shaped as shown to have upright unit support portions 71A–71D and grooves 72A–72D formed in a base along one sides of the corresponding support portions. The recording head units 20A–20D are arranged in contacting relation to one side surfaces of the support portions 71A–71D, respectively, to transfer the heat between them and the corresponding support portions efficiently, and are received in the corresponding grooves 72A–72D.

The base of the block 70 further includes a heat pipe holding bore 73 extending perpendicular to the planes of the support portions 71A–71D and disposed on a side opposite to the support portions. The heat pipe 23 is integrally assembled with the block 70, as shown in FIG. 17, by press fitting the heat pipe 23 into the heat pipe holding bore 73.

FIG. 19 schematically shows the heat pipe 23. The fundamental construction of the heat pipe 23 itself is similar to those of the previous embodiments; but, the construction thereof will be now described again in detail.

The heat pipe 23 is made of good heat-conductive material such as copper and the like to have tubular configuration. In this embodiment, it has a circular cross-section. The reference numeral 61 denotes a porous liquid holding member called a "wick" adhered to an inner surface of the heat pipe 23 and acting to hold, by capillary phenomenon, operating liquid (not shown) enclosed in the heat pipe. The heat pipe 23 itself is hollow, and when the interior of the pipe is maintained in a vacuum condition, the operating liquid exists as saturated vapor in the hollow interior 62 of the heat pipe. Thus, if the heat pipe 23 is heated at its portion, for example a portion C in FIG. 19, by a heating means (not shown), the operating liquid held by the wick 61 is vaporized and the vapor flows or shifts toward a lower temperature portion, for example a portion D in FIG. 19 at a high speed as shown by the arrow E, and then the vapor is cooled at the portion D to return to the liquid form, which is held by the wick again and then is shifted by the capillary phenomenon toward the portion C as shown by the arrow F.

In this way, in the heat pipe 23, since the heat applied thereto is changed to the latent heat in the operating liquid and is transported to the remote location at the high speed, by arranging such heat pipe 23 as shown in FIG. 17, it is possible to maintain the whole heat-conductive block 70 at substantially the same temperature, and, thus, to control or adjust all of the recording head units 20A–20D at substantially a predetermined uniform temperature through the block 70. Incidentally, in FIG. 17, the reference numerals 74A–74D denote leaf springs for urging the recording head units 20A–20D against the corresponding support portions 71A–71D; and 16 denotes a sheet feed roller for the recording medium 51. In this embodiment, the recording medium 51 is fed to the direction X, and the block 70 carrying the recording head units 20A–20D thereon and mounted on a carriage (not shown) is scanned in the direction B, by an appropriate shifting means (not shown). During the scanning movement of the carriage or block, the recording operation can be performed by discharging the ink from the recording head units 20A–20D toward the recording medium 51.

Incidentally, since the temperature control of the recording head units of this embodiment during the recording operation is similar to those of the previous embodiments, the explanation thereof will be omitted. In this embodiment, each recording head unit is constituted by a recording head having 256 nozzles with discharge opening pitch of 16/mm and having a longitudinal length of 20 mm, and the height of each support portion 71A–71D is selected to correspond to the dimension of the recording head. By selecting the thickness of each support portion properly, the change in temperature between the support portions could be minimized.

Figure 20:
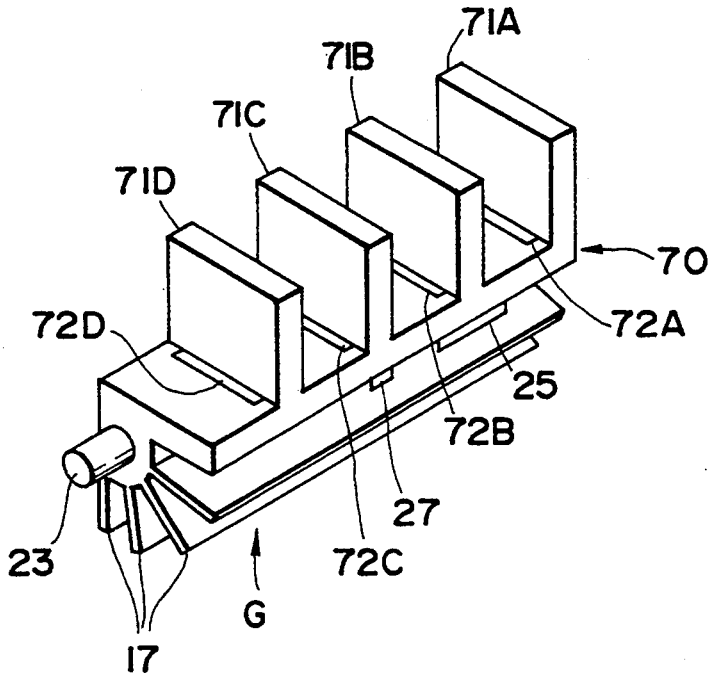
FIG. 20 is a perspective view similar to FIG. 18, but showing a still further embodiemnt.

FIG. 20 shows an alteration of the embodiment shown in FIG. 17. In this alteration, in place of fins 17 mounted on the heat pipe 23, fins 17 are formed on the bottom surface of the heat-conductive block 70 to extend along the heat pipe 23. In this case, by selecting an adequate number and dimensions of the fins 17, it is possible to cool the block 70 with natural cooling action while the block is being moved. Alternatively, it is possible to forcibly cool the block from a direction G by providing an appropriate cooling means (not shown). In this case, the cooling ability of the cooling means may be small.

As mentioned above, according to the embodiments shown in FIGS. 17 and 20, since the plurality of recording head units are held by the single block having the good heat-conductivity and the high speed heat transmitting means such as the heat pipe is provided to the block to permit the heating and heat discharging of the block through the heat transmitting means, by merely providing a single heat transmitting means, it is possible to perform the temperature control of the plural recording head units by means of a single cooling means and heating means through the single heat transmitting means.

As mentioned above, according to the illustrated embodiments, since the cooling and the heating can be effected efficiently by providing the heat pipe comprising the branched portions juxtaposed to the corresponding recording head units and the common portion connecting the branched portions to each other, it is possible to easily control the temperature and to save the energy.

Figure 21:
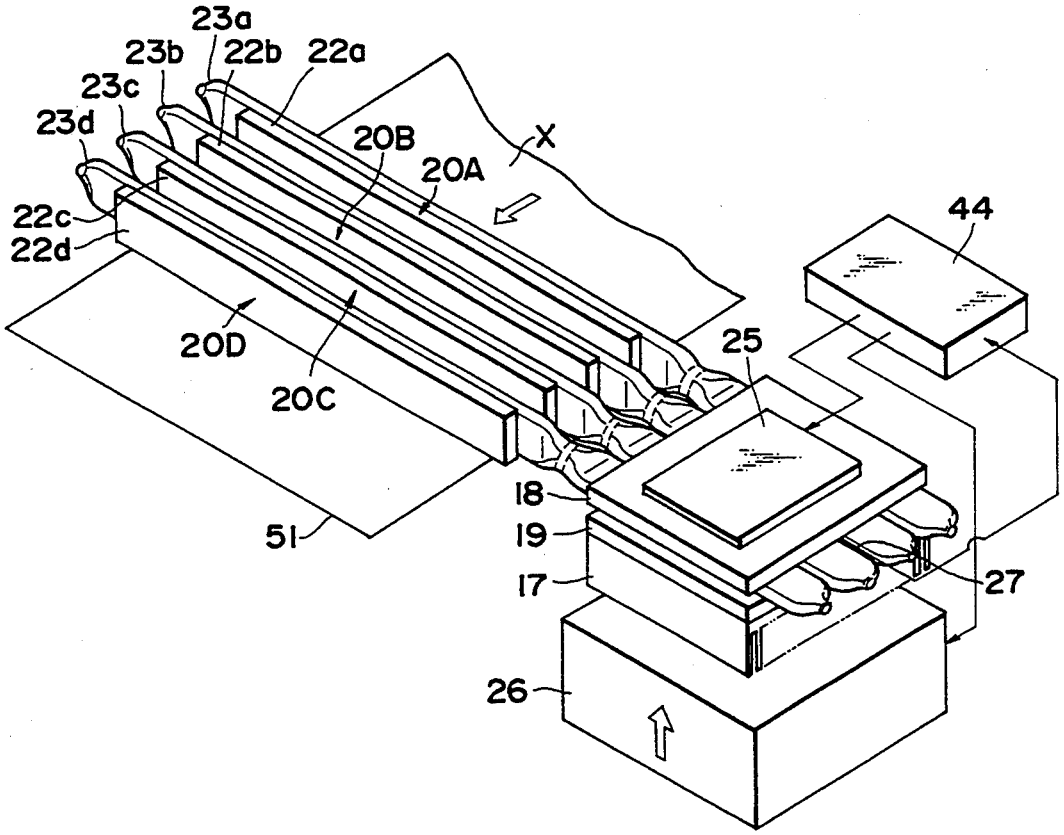
FIG. 21 is a perspective view of a main portion of an ink jet recording apparatus according to a further embodiment of the present invention.

Incidentally, as shown in FIG. 21, heat pipes **23*a*–23*d* juxtaposed to the corresponding recording heads may be interposed between separate flat heat pipes 18 and 19 to create the thermal communication between the recording heads so that the temperatures of the plural recording heads can be adjusted to have substantially the same temperature value. In FIG. 21, each heat pipe 23 thermally contacting with the corresponding recording head has a first flat section connected to the corresponding recording head, and a second flat section extending outwardly of the recording area of the corresponding recording head and interposed between the separate flat heat pipes 18, 19** to be thermally connected to the other heat pipes. These first and second sections of each heat pipe are orthogonal to each other (i.e., one is offset with respect to the other by 90 degrees).

The second flat heat pipes 18, 19 extend across all of the heat pipes **23*a*–23*d* associated with the recording head units 20A–20D to pinch the second sections of the heat pipes 23*a*–23*d*. A plate-shaped heating means such as a heater 25 is disposed on the second heat pipe 18, and a temperature detecting means 27 is also disposed on a bottom surface of the heat pipe 18 between the heat pipes 23*b* and 23*c*. Further, below the second heat pipe 19, a heat discharging means having comb-shaped fins 17** is arranged. And, a cooling means such as a blower for forcibly cooling the fins is also provided.

Incidentally, the heat pipe 18 or 19 has a conventional construction wherein wick networks are arranged on upper and lower inner surface thereof and a plurality of sintered metal wicks are arranged at a predetermined intervals. These heat pipes 18, 19 are connected to the flat surface of the heat pipes **23*a*–23*d* (i.e., second flat sections), heating means 17 and heat discharging means 17. An output signal from the temperature detecting means 27 is sent to the controller 44, which supplies an activation signal to the heating means 25 or the heat discharging means 17** on the basis of such output signal.

Each recording head unit is provided with a thermal energy generating element (electric/thermal converting element) acting as a discharge energy generator for generating thermal energy used for discharging ink, whereby the ink is discharged by utilizing the abrupt change in pressure due to the formation of bubble in the ink by means of the thermal energy. With this arrangement, the change in temperature of each recording head units 20A–20D is transmitted to the heat pipes 18, 19 through the heat pipes **23*a*–23*d*, and then the temperatures of the recording head units are uniformalized by the heat transfer. By detecting the temperature of the heat pipe 18, the latter is cooled or heated. The change in temperature so generated in the heat pipe 18 is transmitted to the heat pipes 23*a*–23*d* to control the temperatures of the recording heads 22*a*–22*d*. Thus, the loss of the electric power is minimized, and the construction of the recording apparatus becomes simple because the heating means 25, heat discharging means 17 and cooling means 26 are used in common, and the registration can easily be attained because the distance between the recording head units 20A–20D** can be reduced.

As mentioned above, in the illustrated embodiment, since the heating means, heat discharging means and cooling means are used in common, the recording apparatus itself becomes simple, the loss of the electric power is minimized, the apparatus becomes inexpensive, and the registration can be easily attained since the distance between the recording head units can be reduced.

Figure 22:
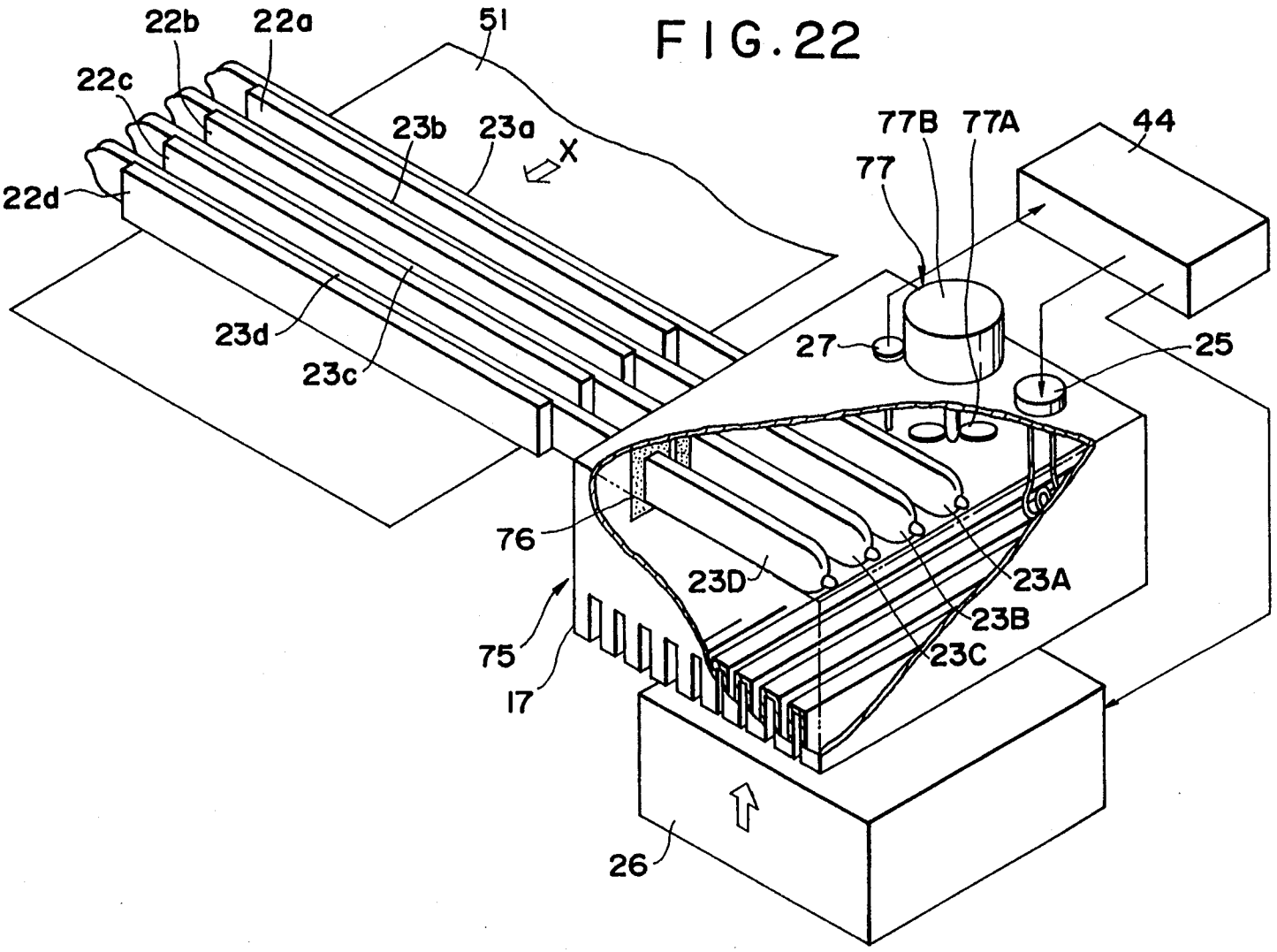
FIG. 22 is a partially broken perspective view of an ink jet recording apparatus according to a still further embodiment of the present invention.

Next, another example of the thermal connection between the heat pipes is shown in FIG. 22. In FIG. 22, one ends of heat pipes 23a–23d juxtaposed to corresponding recording heads 22a–22d are inserted into a liquid medium container 75 which contains heat transferring liquid for transferring the heat between the heat pipes 23a–23d. The container 75 is provided at its one surface with a comb-shaped heat discharging means 17, below which a blower fan 26 for cooling the heat transferring liquid in the container 75 through the heat discharging means 17 is arranged.

The one ends of the heat pipes 23a–23d extend into the container 75 as mentioned above and define extensions 22A–22D, respectively. Between the extensions and the wall of the container 75 through which the extensions extend into the container, there are provided seals 76 for preventing the leakage of the liquid from the container. The reference numeral 25 denotes a heater for heating the liquid in the container; 77 denotes an agitator for agitating the liquid in the container to uniformalize the temperature of the liquid and to provide good heat exchange efficiency between the heat pipes 23a–23d; 77A denotes an impeller of the agitator; and 77B denotes a motor for driving the impeller.

The temperature of the heat transferring liquid in the liquid medium container 75 is detected by a temperature sensor 27. By inputting the detected temperature to a controller 44, the latter controls the activation and deactivation of the heater 25 and the blower fan 26 to maintain the temperature of the liquid constant.

Thus, according to the illustrated embodiment, since the temperatures of the heat pipes 23a–23d can be uniformalized by heating or cooling these heat pipes uniformly through a single container 75 containing the heat medium liquid to permit the temperature control of the recording heads 22a–22d and to uniformalize the temperatures of the recording heads, even when only one recording head (for example, head 22a) is frequently used and the other recording heads are not used during the recording operation, the heat generated in the recording head 22a can be transmitted indirectly to the other recording heads 22b–22d, and, thus, it is possible to maintain the temperature of each recording head at a value required to perform the proper recording, with the efficient use of electric power.

Further, when the color recording is performed, in a normal condition, three colors of ink are not discharged simultaneously because these are generally replaced by the black ink by UCR (under color removal) treatment. Accordingly, in setting the value of the electric power used for the heat discharging, the number of the recording heads to be used may be limited to three, thus eliminating the provision of the heat discharging means having excessive cooling ability.

Incidentally, since the recording heads 22a–22d and the heat pipes 23a–23d are constructed as a unit by integrally connecting these elements to each other, the attachment of these elements to the liquid medium container 75 can be simplified, and, by making the seals 76 of flexible material such as rubber sheet, the position adjustment of the recording heads 22a–22d can easily be done.

As mentioned above, according to the illustrated embodiment, since there are provided the heat transmitting members capable of transferring the heat between the recording heads, the container for receiving and holding the extensions of the heat transferring members extending outwardly of the heat transferring areas between the recording heads and the members and for accommodating heat medium liquid capable of permitting the heat exchange between it and the heat transferring members, and the control means for controlling the temperature of the heat medium liquid, the following advantages are obtained.

That is to say, it is possible to control the temperatures of a plurality of recording heads uniformly by using a single heating means and a single cooling means, thus making the recording apparatus compact and inexpensive.

Further, the efficiency of the electric power to be used can be improved, and particularly, the electric power used for the cooling can be minimized.

In addition, by assembling the recording heads and the heat transferring members integrally, they can be removably mounted on the container, thus facilitating the replacement of the assembly.

Next, an embodiment regarding the positional relationship between adjacent recording heads and the configuration of the heat pipe for improving the heat exchanging ability will be explained.

Figure 23:
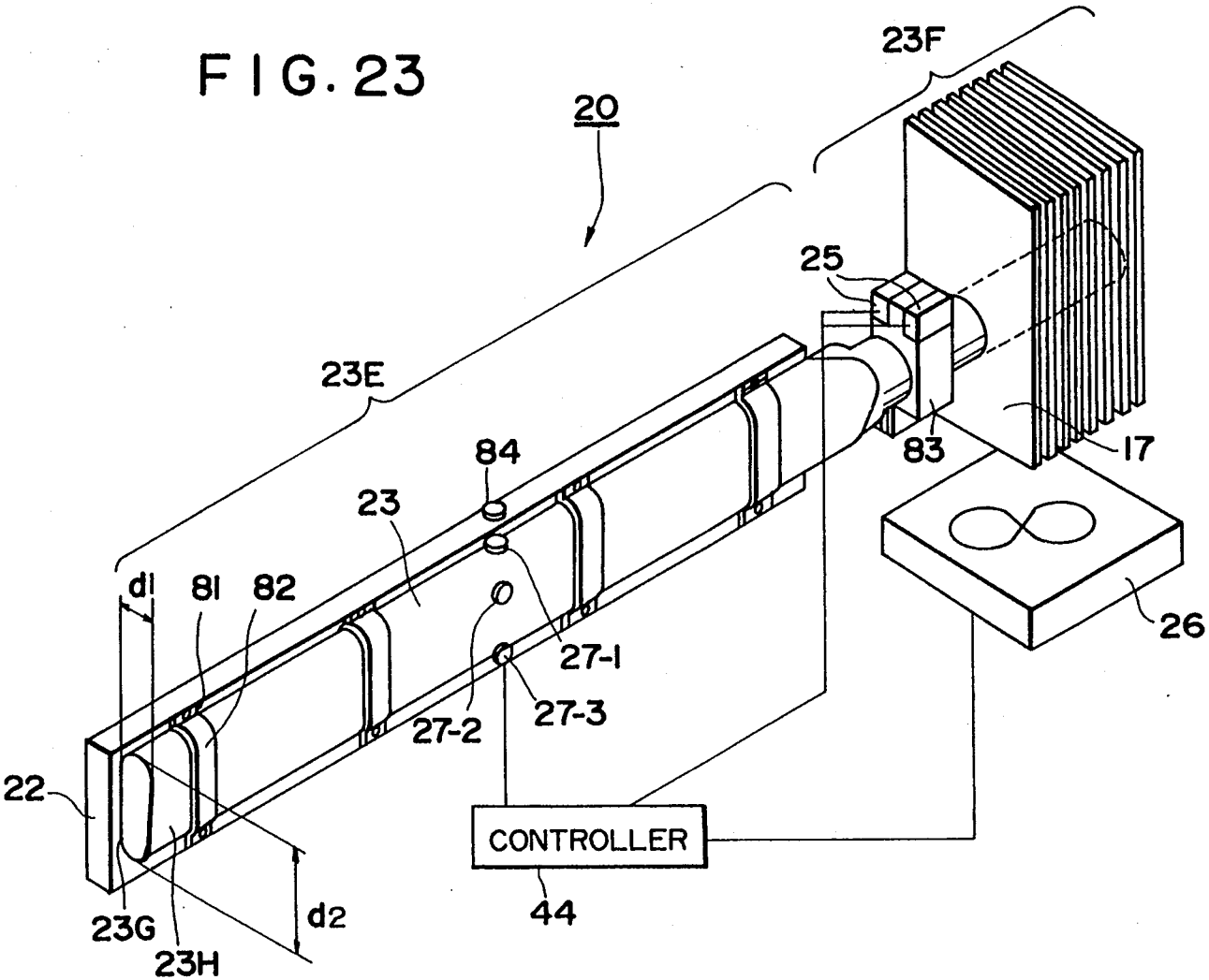
FIG. 23 is a schematic perspective view showing an example of an ink jet recording head forming a part of the ink jet recording apparatus of the present invention.

FIG. 23 is a schematic perspective view showing an example of a recording head unit 20 comprising a recording head 22 and a heat pipe 23 acting as a heat exchanging means, which forms a part of an ink jet recording system according to the present invention.

In FIG. 23, the recording head 22 is constituted by a full-line type recording head having discharge openings disposed through the whole width of a recording medium. The recording head used in this embodiment has 4736 discharge openings arranged side by side at an interval of 63.5μ. And, a thermal energy generating element (not shown) is provided at each discharge opening of the recording head 22. When the thermal energy generating element is energized, the temperature of the ink in the vicinity of the thermal energy generating element is abruptly increased to cause the film boiling and to form a bubble in the ink. The ink is discharged from each discharge opening by utilizing the abrupt change in pressure in the ink due to the formation of such bubble.

The heat pipe 23 is made of copper and acts as the heat exchanging means, and includes a first heat exchanging section 23E contacting with the whole longitudinal area of one side of the recording head to perform the heat exchange therebetween, and a second heat exchanging section 23F extending outwardly of a recording area of the recording head. The copper is preferable since it has high heat-conductivity. By using this heat pipe, the uniform temperature control of the recording head can easily be effected.

Now, with respect to the heat pipe to be used, the heat conveying amount of the heat pipe must be considered. That is to say, since the heat conveying amount of the heat pipe has a certain limitation, in order to obtain the adequate thermal feature, it is necessary to use a heat pipe which can transmit more calories than the maximum calories that can be transmitted from the recording head to the heat pipe or from the heat pipe to the recording head.

The limitation of the heat conveying amount varies in accordance with diameter R of the heat pipe, and the larger heat conveying amount is obtained as the diameter R of the heat pipe is increased.

On the other hand, when the color image is recorded by using a plurality of recording heads as will be described later, the longer the distance d between the recording heads, the more the memory amount for storing the image data is increased, which leads to increases in the cost of the recording system.

Also in order to improve the accuracy in the registration (alignment between the recording heads) and to achieve the compactness of the recording apparatus, the shorter distance d between the recording heads is preferable.

In consideration of the above requirements, according to this embodiment, in the heat pipe 23, the first heat exchanging section 23E for effecting the heat exchange due to the heat transfer between the heat pipe 23 and the recording head 22 is constituted by a flat heat pipe having an elongated rectangular cross-section by flattening a circular pipe by the press, and the second heat exchanging section 23F for mainly effecting the heat discharge has a circular cross-section.

In this case, "flat" configuration means that, as shown in FIG. 23, it has at least one planar portion 23G, and the shortest diameter $d_1$, the longest diameter $d_2$ of the pipe and the diameter R of the original circular pipe have the following relation; $d_2<R<d_1$. Incidentally, there is the following relation: $d_1<d$ (head-to-head distance).

By using the heat pipe having such configuration, it is possible to reduce the distance between the recording heads. Further, it is possible to efficiently perform the heat exchange without reducing the heat conveying amount of the heat pipe.

The recording head 22 is attached to one side surface of the heat pipe 23 by means of equidistantly spaced retainers (for example, four) 81, 82 with the interposition of, for example, silicone grease. A plate-shaped portion 82 of each retainer is made of SUS or phosphoric bronze and has a thickness of 0.3 mm and a dimension of 27.6 mm×10 mm. Since the plate-shaped portion 82 is very thin, if it contacts the heat pipe directly, a thermal problem such as heat loss is negligible.

In attaching the heat pipe 23 to the recording head 22, the heat pipe may be attached to a base side of the recording head on which the electric/thermal converters for generating the thermal energy used to discharge the ink are formed, or may be attached to the other side, i.e., top plate side opposite to the base side. However, in order to prevent the heat generated by the electric/-thermal converters from being accumulated on the base and to improve the quality of the recorded image, the heat pipe is preferably attached to the base side.

Heat discharging fins 17 acting as a cooling means are attached to the second heat exchanging section 23E by press fit. Further, in order to maximize the heat discharging ability of the fins 17, a fan 26 constituting a part of the cooling means is arranged near and below the heat discharging fins 17 so as to direct an air stream in a direction opposite to the ink discharging direction. The position of the fan 26 is not limited to the illustrated one, but the fan may be installed at an optimum position where there arises no problem regarding the ink mist (described later) and where the heat discharge assist effect and/or the compactness of the recording apparatus can be achieved. Incidentally, while the fan 26 was installed on the body of the apparatus, it may be installed on the recording unit. The heat discharging fins 17 are disposed in planes perpendicular to a longitudinal direction of the heat pipe. By so arranging the fins 17, the air stream supplied from the bottom of the fins by the fan 26 is prevented from flowing toward the recording head (recording area). Consequently, the ink mist is prevented from flying within the recording apparatus and the problems caused by the flying of the ink mist can be reduced.

The heat discharging fins 17 may be made of material having good heat discharging feature, as similar to the heat pipe 23. However, since copper is heavy, the fins are preferably made of light material having good heat discharging feature.

For example, the fins may be made of aluminum material which has less heat discharging ability than copper but is lighter than the latter.

A temperature sensor 27 acting as a temperature detecting means for detecting the temperature of the heat pipe 23 is disposed at a predetermined position on a peripheral surface of the heat pipe at an intermediate of the length of the recording head 22. Further, a heater 25 acting as a heating means for heating the heat pipe 23 is disposed at a predetermined position outside of the recording area of the recording head 22 as will be described later.

The temperature sensor used in this embodiment comprises a bean-like PCB type thermistor having a dimension of $\phi$1.5 (diameter of contacting area with the heat pipe)×2.5 mm (thickness). The sensor has preferably the larger dynamic range within a temperature range to be detected (for example, 0° C.–70° C.), and also preferably has a high sensitivity.

As mentioned above, the sensor 27 is mounted on the intermediate portion of the recording head with respect to the longitudinal direction thereof. In the illustrated embodiment, the whole length of the recording head is 330 mm, and, accordingly, the sensor 27 is arranged so that the center thereof is positioned at a location spaced from the head end by 165 mm.

Further, in view of the positional relationship between the discharge openings and the sensor, the latter is positioned between 2348th (from the head end) opening and 2356th opening.

Incidentally, the temperature detecting means (sensor) may be of the contacting type directly attached to the heat pipe, or may be of the non-contacting type. Particularly, as is the present embodiment, when it is desired to detect the temperature of the heat pipe more stably with good response feature, it is preferable to use the sensor of the contacting type.

The reasons for arranging the sensor at the longitudinal central position of the recording head are as follows.

Figures 24A, 24B, 24C:
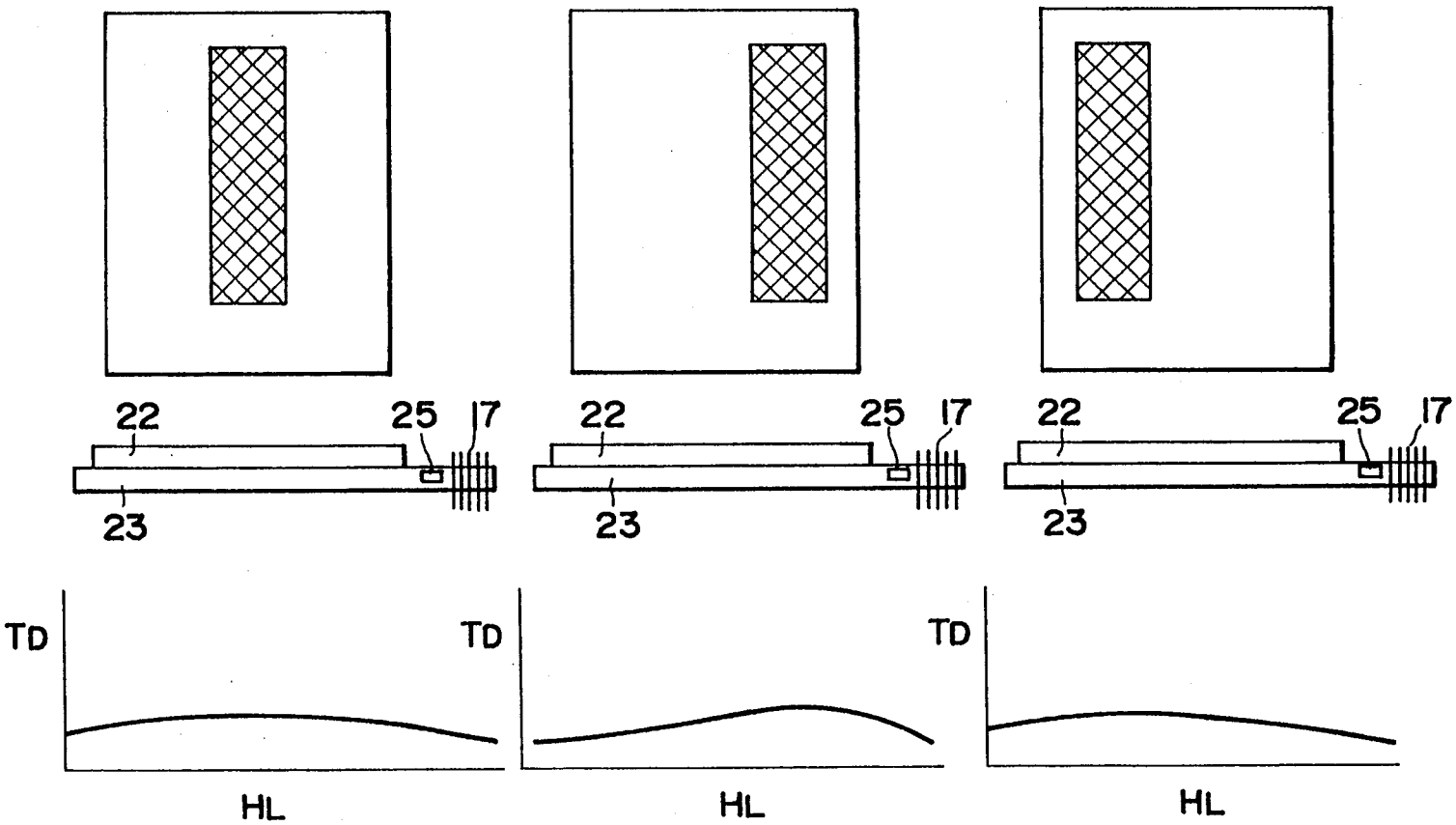
FIGS. 24A to 24C are views showing features of temperature distributions of a heat pipe generated by the difference in position of solid recording area recorded on the recording medium.

That is to say, when the local solid recording is effected, the change in the temperature distribution TD along the longitudinal direction HL of the heat pipe. More particularly, the solid recordings are effected as shown in FIGS. 24A, 24B and 24C, the temperature of an area of the recording head corresponding to the solid recording area is increased, and the heat is transferred to the heat pipe so that the temperature of an area of the heat pipe corresponding to the heated area of the head is slightly increased more than the remaining area. For example, if the temperature sensor is arranged at one end of the heat pipe, when the solid recording is effected on the recording medium at an area corresponding to the other end of the heat pipe, the detection of that temperature is delayed, with the result that it is difficult to perform the proper temperature control.

On the other hand, by arranging the temperature sensor at the longitudinal central position of the recording head which corresponds to a position nearest to any position on the recording head, even if the change in temperature occurs at any position on the recording head, such change in temperature can be quickly detected, thus permitting the proper temperature control with good response feature.

Further, the temperature sensor may be disposed at a predetermined location on the peripheral surface of the heat pipe corresponding to the longitudinal central position of the recording head (or the longitudinal central portion of the discharge opening forming area).

For example, as shown in FIG. 23, the sensor is disposed at a central portion 27-2 on the peripheral surface of the heat pipe having an oval cross section.

The position of the temperature sensor 27 is not limited to the above position 27-2, but the sensor may be disposed at a position 27-3 corresponding to an end of a larger diameter of the oval in the vicinity of the discharge opening forming area of the recording head, or at a position 27-1 corresponding to the other end of the larger diameter of the oval opposite to the position 27-3. In any cases, the temperature sensor provides the proper temperature control with good response feature; however, preferably, by disposing the temperature sensor at the position 27-3 nearest the discharge opening forming area where the heating elements are arranged, it is possible to perform the temperature control with more excellent response feature.

On the other hand, the heater 25 for heating the heat pipe 23 is attached to the heat pipe 23 by means of an appropriate attachment 83 at an area between the heat discharging fins 17 mounted on the heat pipe 23 and the recording area of the recording head.

In the illustrated embodiment, two heaters 25 are used, and these heaters are attached to the extension of the heat pipe extending outwardly of the recording area of the recording head through the attachment 83 made of copper having good heat-conductivity, at a side opposite to a side where the ink discharge openings are provided, because it is preferable to arrange the heaters with small installation space and without increasing the distance between the recording heads for example when a plurality of recording heads are arranged side by side.

The attachment 83 for attaching the heaters to the heat pipe is thermally contacted to the heat pipe with an appropriate contacting area so that the heat flux (generated by the heating of the heaters 25) tending to create a "drive-out" phenomenon in the heat pipe is not concentrated in the heat pipe.

Further, in the illustrated embodiment, a power transistor is used as the heater (since it is compact but has a large heating value); the material and thickness of the attachment are so selected that the power transistor is not heated higher than a rated temperature when the heat pipe is heated.

Figure 25:
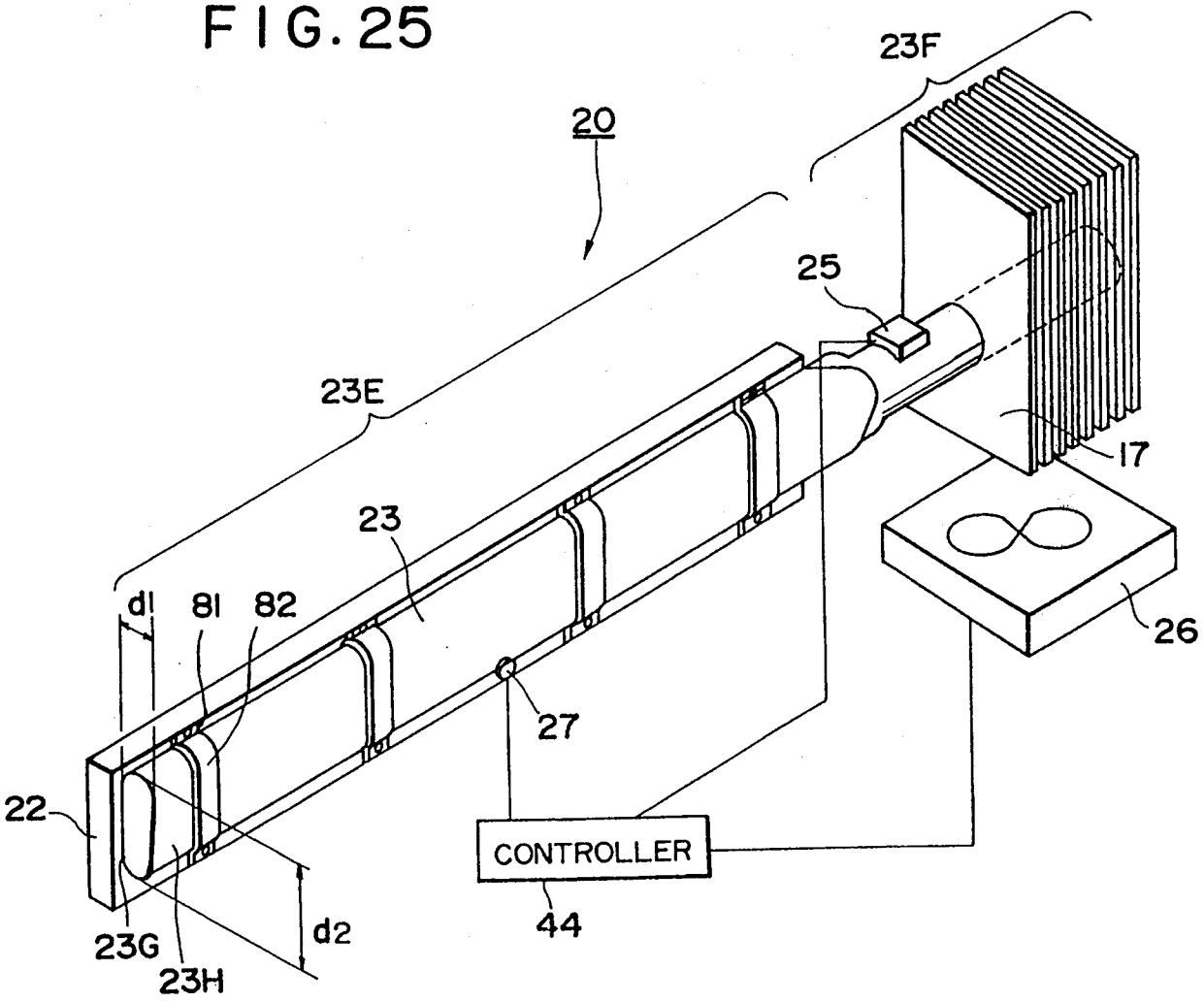
FIG. 25 is a schematic perspective view showing another example of an ink jet recording head forming a part of the ink jet recording apparatus of the present invention.

Incidentally, as shown in FIG. 25, the heater 25 may be directly attached to the heat pipe. In this case, it is preferable to attach the heater to the heat pipe with such a contacting area as to prevent a so-called "drive-out" phenomenon in which the operating fluid in the heat pipe is vaporized up not to flow the liquid by activating the heater.

Further, if the heater 25 is arranged too near the recording head 22, the recording head 22 is directly influenced upon the heat of the heater without through the heat pipe 23; accordingly, it is preferable that the heater is spaced from the recording head at a certain distance.

Figure 26:
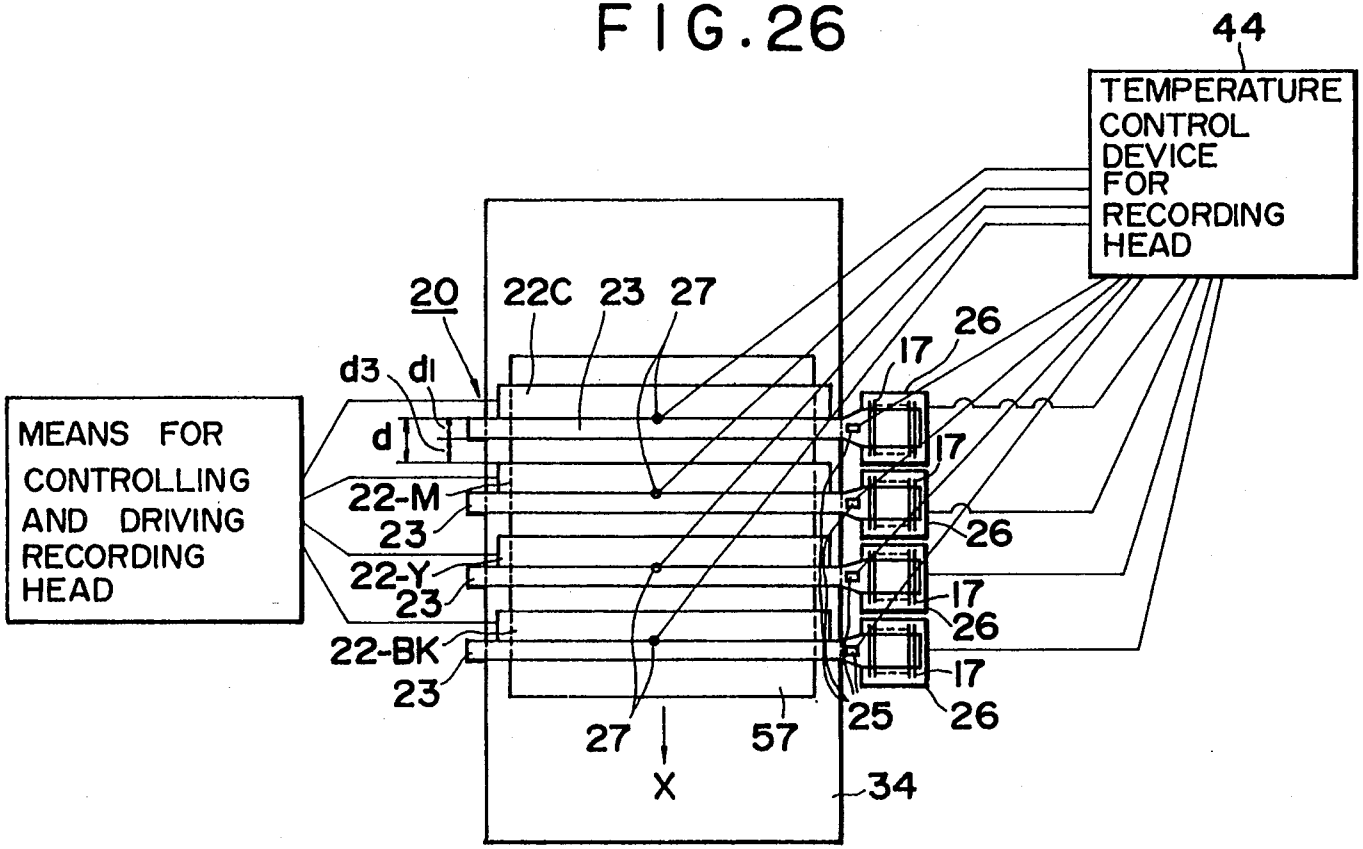
FIG. 26 is a schematic plan view showing an example of an ink jet recording apparatus incorporating the present invention.
Figure 27:
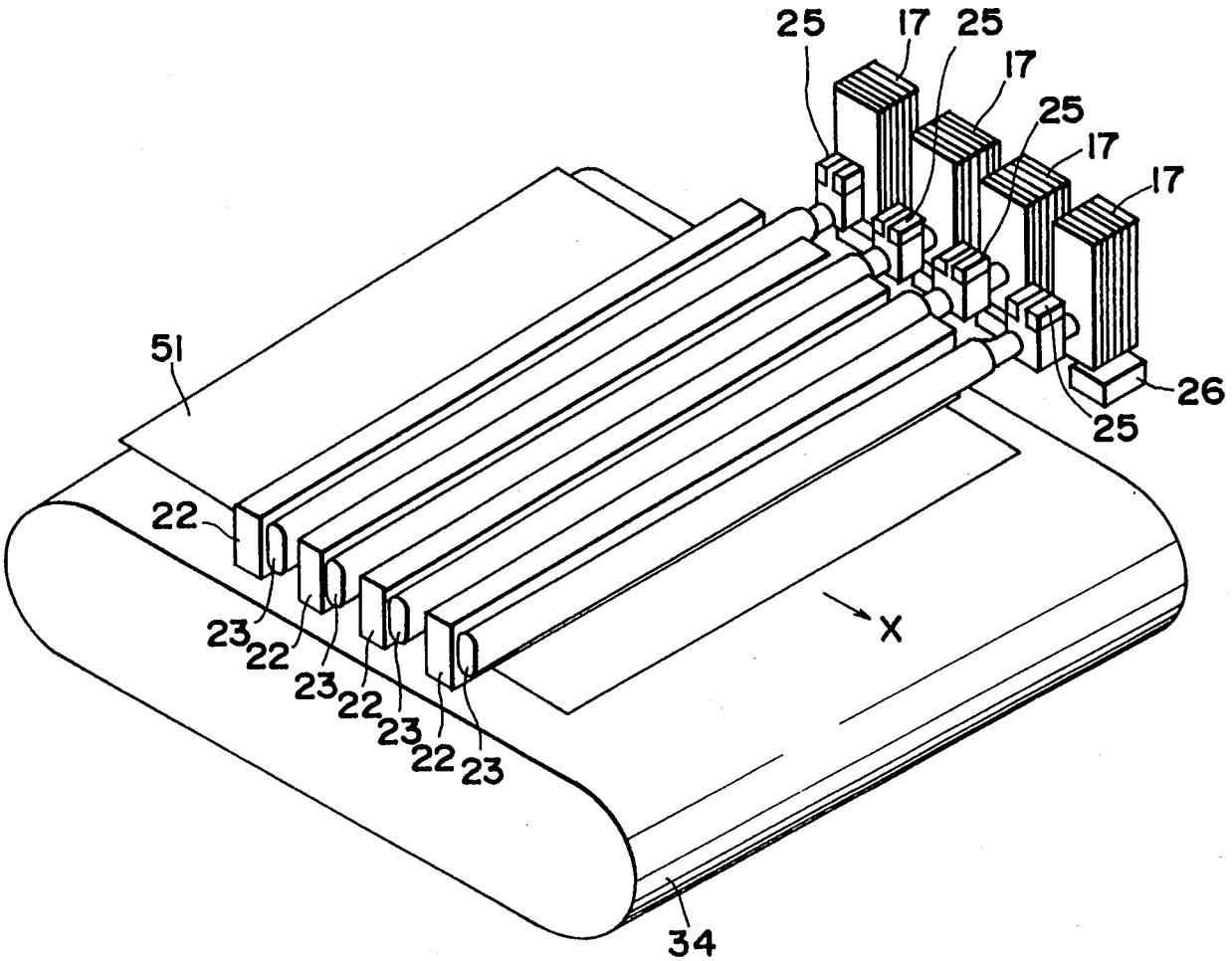
FIG. 27 is a schematic perspective view showing an example of an ink jet recording apparatus according to the present invention.

FIGS. 26 and 27 show a recording apparatus which is constituted by arranging the recording heads 22 shown in FIG. 23 side by side to permit the color recording with cyan ink, magenta ink, yellow ink and black ink. That is to say, since a plurality of recording head units 20 each having the construction as shown in FIG. 23 are arranged side by side, the temperature sensors 27, heaters 25, heat discharging fins 17 and fans 26 are provided individually in the corresponding recording heads 22. Of course, it is possible to thermally connect a plurality of heat pipes to each other as previously mentioned. In this case, the above elements 25, 17 and 26 may be single, respectively, other than the temperature sensors 27.

In this way, by adjusting the temperatures of the recording heads 22 independently, it is possible perform the temperature control with higher accuracy.

By the way, in the recording performed by using the recording heads arranged side by side, there arise problems regarding the registration and the memory cost. More specifically, when the distance between the recording heads is long, it is very difficult to obtain the accuracy of the head-to-head distance and it is necessary to increase the capacity of the memory. Accordingly, the shorter distance between the recording heads is preferable. To this end, as shown in FIG. 27, each heater 25 is disposed on the corresponding heat pipe at a position which does not influence upon the distance between the recording heads, i.e., a position on a side of heat pipe which is opposed to a side where the discharge openings of the recording head are arranged. That is, each heater is arranged at an upper side of the heat pipe.

Incidentally, among four recording head units 20 arranged side by side, in the first and fourth recording head units, the heaters 25 are not necessarily disposed at the upper sides of the respective heat pipes, but may be disposed on outer sides of the heat pipes.

The recording head units 20 having the above-mentioned construction are so designed that the temperatures of the recording heads 22 can be adjusted to a desired temperature value by selectively activating the heaters 25 or the fans 26 through the controller 44 on the basis of the detected temperature from the temperature sensors 27.

Incidentally, the fan 26 may be of sirocco type which is compact but can provide an adequate wind amount.

As mentioned above, each heat pipe has the first heat exchanging section 23E having a flat configuration and the second heat exchanging section 23F having a cylindrical configuration. In the case where a plurality of recording heads including such heat pipes are arranged side by side to permit the color recording, when the shorter diameter of the first heat exchanging section 23E is $d_1$, the longer diameter thereof is $d_2$, the distance between the heat pipe and the adjacent recording head is $d_3$ and the distance between opposed surfaces of the adjacent recording heads is d, it is necessary meet the relation $d > d_1$ between at least $d_1$ and d.

The reasons for deforming each heat pipe 23 as mentioned above will be described. For example, it is assumed that the head-to-head distance $d = 10$ mm or less is requested upon the requirements regarding the memory cost, construction of the apparatus, accuracy of the registration and the like. Incidentally, the distance $d = 10$ mm is determined by the requirements of the apparatus, itself and thus, in the recording apparatuses of other embodiments, other values of distance will be requested.

On the other hand, when a recording head of A3 full-line type (400 dpi) having an maximum average heat discharging amount (value obtained by deducting the heat amount absorbed by ink from the heat amount generated by the whole recording head and then by dividing the result by time) is used as the recording head in the above-mentioned recording apparatus, it is necessary to use a heat pipe of a diameter R (12.7ϕ) having the heat conveying amount of 100–120 W.

Therefore, the head-to-head distance d and the diameter R of the heat pipe which are requested as above gives the relation $d<R$, which does not meet the aforementioned relation $d>d_1$.

Accordingly, in order to meet the relation $d>d_1$, the area corresponding to the first heat exchanging section 23E of the heat pipe was deformed in the flat configuration having a thickess of 5 mm.

In the illustrated embodiment, the above-mentioned values d, $d_1$, $d_2$ and $d_3$ were the follows: $d=10$ mm, $d_1=5$ mm, $d_2=15$ mm, $d_3=5$ mm. Incidentally, the thickness of the recording head was about 13 mm. The present embodiment is not limited to such values, but may use various values so long as the following relations are met.

That is to say, the distance between the recording heads is desirable to be included within a range $0 \leqq d \leqq 20$ (mm) in consideration of the accuracy of the registration. To the contrary, the diameter of the heat pipe is requested to be included within a range $10 \leqq R \leqq 30$ (mm) in view of the optimum heat exchanging feature.

Accordingly, although it is necessary to deform the heat pipe in the flat configuration as mentioned above by the press, if the shorter diameter $d_1$ is too short, it is feared that the flowing of the operating liquid in the heat pipe is badly influenced; thus, as a stable dimension, the shorter diameter is preferable to be included within a range $5 \leqq d_1 \leqq 20$ (mm).

Further, the distance $d_3$ between the side surfaces of the adjacent heat pipe 23 and of the recording head 22 is preferable to be included within a range $0 \leqq d_3 \leqq 15$ (mm).

The excessive longer distance $d_3$ is undesirable in view of the accuracy of the registration and/or the memory capacity, and the excessive shorter distance $d_3$ causes the danger that one recording head will influence on the adjacent recording head. Further, unless the head-to-head distance d and the shorter diameter $d_1$ meets the relation $d>d_1$, the adjacent recording head and heat pipe are contacted with each other, thus enabling the stable temperature control of the recording heads.

In addition, as a range which can minimize the above-mentioned had thermal influence between the adjacent heat pipe and recording head, the shorter diameter $d_1$ of the heat pipe and the distance $d_3$ between the heat pipe and the adjacent recording head has preferably a relation $d_3 \geqq d_1$.

Further, as mentioned above, the second heat exchanging section has the cylindrical configuration, on which 38 aluminum plates each having a thickness of 0.3 mm (dimension thereof is 20×80 mm) are press-fitted at a pitch of 2 mm to form the heat discharging fins. In this way, by deforming the first heat exchanging section 23E of each heat pipe in the flat configuration, it is possible to use the heat pipes providing the adequate heat conveying amount, and the second heat exchanging section (heat discharging section) 23F has the adequate heat discharging ability, thereby permitting the temperature adjustment of the whole recording heads at the desired temperature value.

Next, an example of the operation of the illustrated embodiment will be explained.

When a record start switch (not shown) is turned ON, first of all, the temperature of the heat pipe 23 is detected by the temperature sensor 27. When the detected temperature is lower than a predetermined temperature (referred to as "set temperature" hereinafter) which must be kept during the recording operation (for example, 48° C. (+4° C., −3° C.) in the illustrated embodiment), the controller 44 activates the heater 25 to heat the recording head 22 through the heat pipe 23. In this case, the contacting area 23G between the heat pipe 23 and the recording head 22 acts as a condensation area where the operating fluid in the heat pipe 23 can be liquidized, and thus, the operating fluid vaporized by the heat from the heater 25 can be uniformly dispersed through the condensation area and is condensed to uniformly discharge the latent heat, with the result that the recording head 22 is subjected to the uniform heat flux, whereby the recording head is quickly and uniformly heated to reach the set temperature. When the recording head reaches the set temperature, the heater 25 is turned OFF.

When the recording head 22 reaches the set temperature, it is judged that the recording is permissible. In this point, if a predetermined image signal is inputted, the some of the electric/thermal converting elements corresponding to the image signal are energized to apply the thermal energy to the associated ink, thereby discharging the ink from the associated ink discharge openings. The discharged ink is flying toward the recording medium 51 and is absorbed by the latter to form a desired image thereon. When the recording operations are continued, the recording head is heated by the residual thermal energy remaining in the recording head (among the applied thermal energy). In this case, if the detected temperature from the temperature sensor 27 deviates from the set temperature by a tolerable value or more, the controller 44 activates the fan 26 to direct the air stream to the fins 17, thereby starting the heat discharge of the recording head 22 through the heat pipe 23. In this case, the contacting area 23G between the heat pipe 23 and the recording head 22 acts as a vaporization area for the operating liquid, with the result that the greater amount of operating liquid can be vaporized in a zone into which the greater heat flux is flowing, and the lesser amount of operating liquid can be vaporized in a zone into which the lesser heat flux is flowing, and, thus, the operating liquid is vaporized in accordance with the heat values. Further, in a zone into which no heat flux is flowing, the operating fluid once vaporized is condensed there to discharge the latent heat for supplying the heat value. Since the vapor has no heat resistance and the transfer of heat can be effected instantaneously, the uniformalization of the interfacial temperature between the operating liquid in the vaporization area and the vapor can be effected instantaneously. Accordingly, even when the heat flux flowing into the heat pipe has local dispersion, the interfacial temperature can be maintained substantially constant. Accordingly, even if the heat flux having the local dispersion is created in response to the image signal, the recording head 22 can be maintained to substantially constant value, by the action of the uniformalization of temperature in the heat pipe 23. And, the heat amount remaining after the uniformalization of the interfacial temperature is transported to the second heat exchanging section 23F of the fins 17 instantaneously, and is condensed there to generate the heat value. The generated heat value is transmitted to the air stream fed by the fan 26 through the fins 17 and thus is dispersed in the air.

The image recording operation is stably continued while the temperature of the recording head is maintained at substantially the set temperature as mentioned above, by properly activating or deactivating the fan 26 through the controller 44 on the basis of the detected temperature from the temperature sensor 27.

Incidentally, the temperature of the recording head to be adjusted is not limited to the above-mentioned 48° C. (+4° C., −3° C.), but may be properly determined in accordance with the ink and recording head to be used and the service conditions; however, it is preferable that the set temperature is adjusted within a range from about 35° C. to about 60° C.

Further, the temperature control may be performed by always activating the cooling means (i.e., ON/OFF control for the cooling means is not performed) and by adjusting the temperature of the recording head by means of the heating means at need, or by always activating the heater (heating means) (i.e., ON/OFF control for the heating means is not performed) and by adjusting the temperature of the recording head by the ON/OFF control of the cooling means at need, as well as by properly performing the ON/OFF control of the heating means and the cooling means as mentioned above.

As mentioned above, by mounting the heat pipe on the recording head and by heating or cooling the recording head through the heat pipe on the basis of the temperature of the recording head, it is possible to heat or cool the elongated recording head uniformly, and, thus, to control the temperature of the elongated recording head uniformly and stably. Consequently, the ink discharge condition is considerably stabilized, thus greatly improving the stability of the image. Further, with the arrangement as this embodiment, since the fins and fan are disposed out of the recording area of the recording head, the strong air stream from the fan can be prevented from flowing into the recording area, thus preventing the disturbance of the flying ink, thereby improving the stability of the image.

Figure 1:
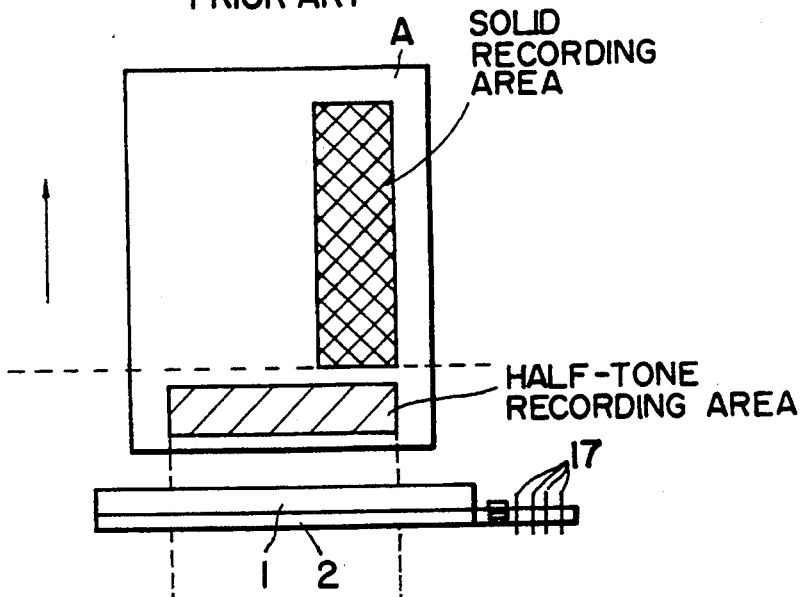
FIG. 1 PRIOR ART
FIG. 1 is a plan view showing an example that images are recorded on partial areas of a recording medium.
Figure 2B:
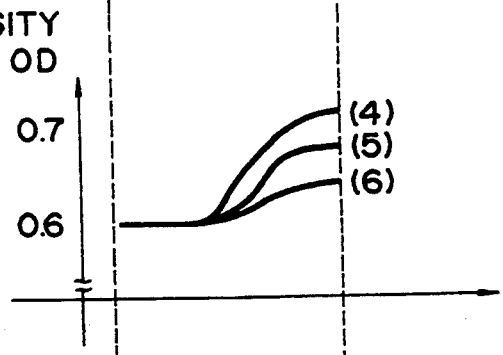
FIG. 2B PRIOR ART
FIG. 2B is a graph showing the dispersion in recorded density when the images as shown in FIG. 1 are recorded.
Figure 2A:
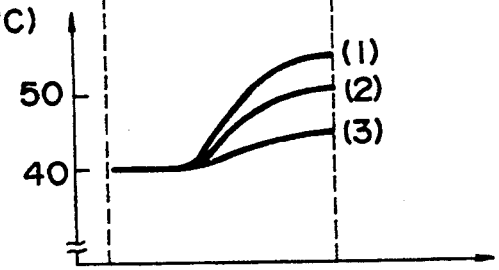
FIG. 2A PRIOR ART
FIG. 2A is a graph showing temperature distribution along a longitudinal direction of a recording head when the images as shown in FIG. 1 are recorded.
Figure 3:
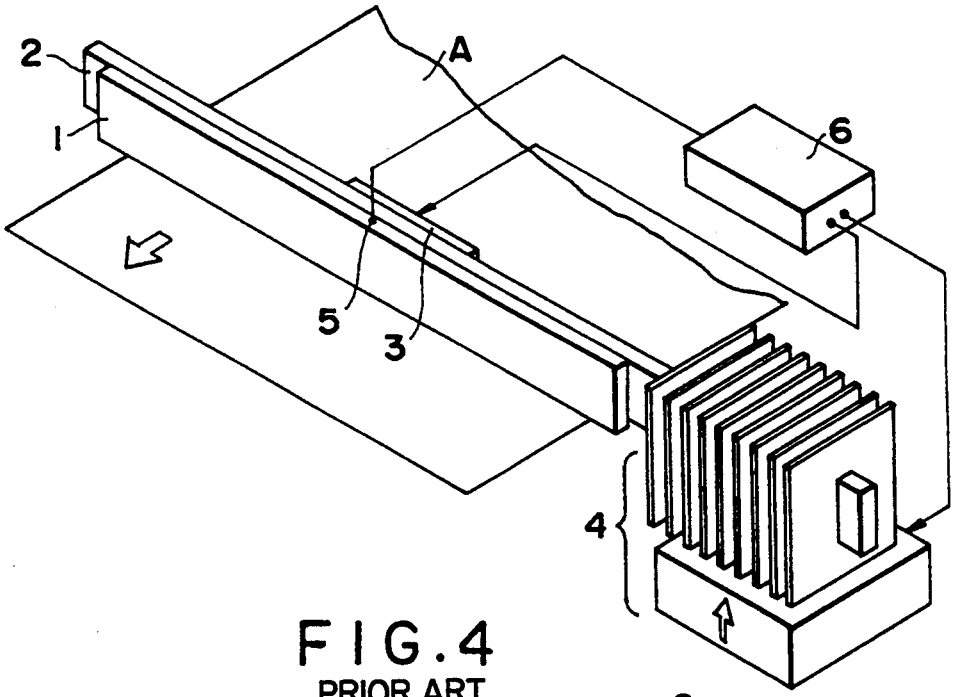
FIG.3 PRIOR ART
FIGS. 3 and 4 are perspective views of main portions of ink jet recording apparatuses previously proposed by the inventor et al.
Figure 4:
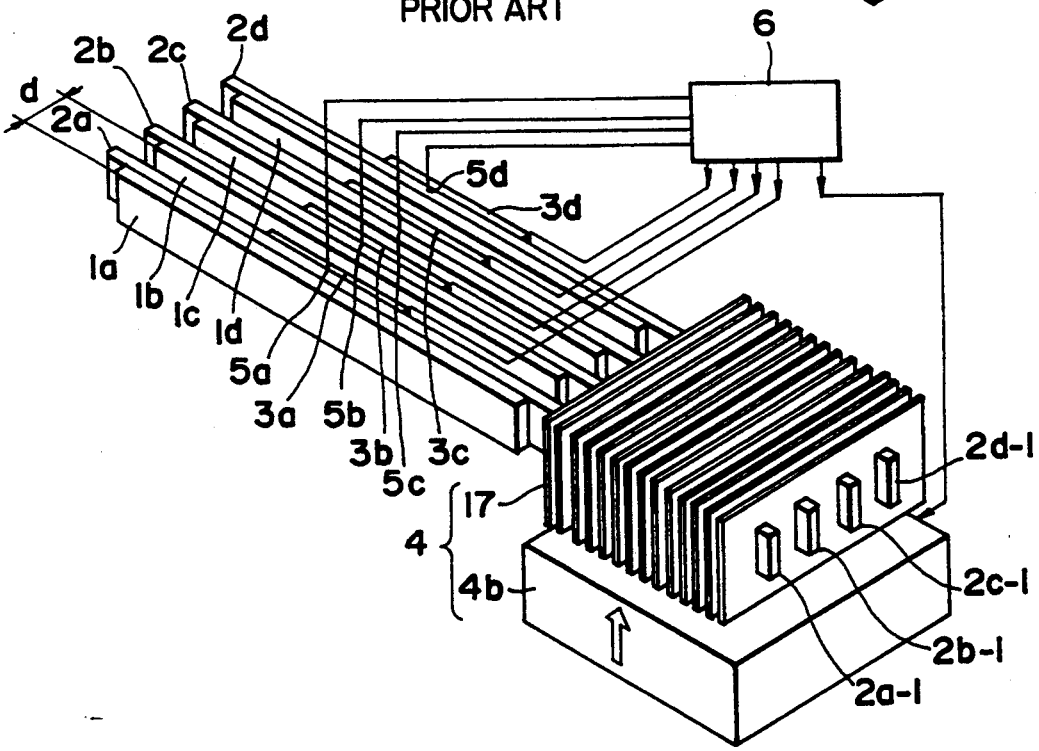
FIG.4 PRIOR ART

Since the temperature of the recording head is controlled in this way, even when the image as shown in FIG. 1 is continuously recorded on sixty A4 size recording mediums, the dispersion in temperature in the longitudinal direction of the recording head can be greatly suppressed, as shown in FIG. 2A(3).

Consequently, the dispersion in density of the half-tone recording area after 60 sheets have been recorded can also been greatly suppressed, as shown in FIG. 2B(6).

As a comparison, an example of the temperature control in the recording system wherein the temperature sensor is disposed at a position 84 shown in FIG. 23 on the recording head 22 will be explained.

In this example, when the image as shown in FIG. 1 is continuously recorded on sixty A4 size recording mediums, as shown in FIG. 2A(2), the great dispersion in temperature occured in the longitudinal direction of the recording head, and the dispersion in density of the half-tone recording area after 60 sheets have been recorded was also great, as shown in FIG. 2B(5). The reason is that, since the heat generated in the solid recording area of the recording head 22 is difficult to be transmitted to the temperature sensor 84, the difference between the detected temperature at the temperature detecting position 84 and the temperature in the solid recording area is great, thus making the proper control of the cooling means difficult.

To the contrary, according to the embodiment shown in FIG. 23, since the temperature of the recording head is detected through the heat pipe having substantially the same temperature through its length regardless of the temperature difference in the recording head, at the longitudinal central position of the contacting area between the heat pipe 23 and the recording head 22, it is possible to control the cooling means the heating means with high accuracy, and, thus, to maintain the temperature of the recording head at substantially the constant temperature value at all times.

Further, as a comparison, if a cylindrical heat pipe (having a diameter of 10ϕ) which can be disposed between the recording heads was used, since the maximum heat conveying amount of this heat pipe was less than that of the heat pipe of the illustrated embodiment by about 50%, such heat pipe could not utilized. For example, when the electric power of 80 W was generated as in the case of the previous embodiment, the difference in temperature of about 10° C. was created between both ends of the first heat exchanging section, thus worsening the quality of the image.

In this way, by deforming the cross-section of the first heat exchanging section in the elongated rectangular shape and by keeping the second heat exchanging section in the circular cross-section, the following advantages are obtained:

That is to say, first of all, since the first heat exchanging section of the heat pipe has the elongated rectangular cross-section, it is possible to reduce the distance d between the adjacent recording heads, to reduce the cost of the recording system, to make the system small-sized and to facilitate the attaching of the heat pipe to the recording head. Further, since the second heat exchanging section has the circular cross-section, the vapor of the operating liquid generated in the first heat exchanging section can be transmitted to the whole second heat exchanging section efficiently, thus improving the heat discharging ability and easily adjusting the temperature of the whole recording head or of the whole contacting area between the heat pipe and the recording head to substantially uniform temperature value.

Further, since the temperature detecting means is disposed on the first heat exchanging section of the heat pipe (heat exchanging means) at the longitudinal central position thereof, the change in temperature of the recording head at any position thereof can be detected through the heat pipe with good response feature.

Further, since the temperature adjusting means for the recording heads are independently arranged when the color recording is performed by using a plurality of recording heads, it is possible to adjust the temperatures of the recording heads independently and stably.

In addition, since the temperature controlling means is provided in the end areas of the heat pipe (heat exchanging means) extending outwardly of the recording area of the recording means which is associated with the heat exchanging means, it is possible to adjust the temperature without affecting the thermal influence upon the recording means, and, even when the plurality of recording means are arranged side by side, it is possible to reduce the distance between the recording heads adequately, thus reducing the memory cost and improving the accuracy of the registration.

By the way, since object of the adjustment of the temperature of the recording head through the heat pipe was to control the temperature of the recording head at a given temperature range near the set temperature, the degree of the heating and cooling could not be greatly increased, and, thus, it took a long time to increase the temperature of the recording head from its stand-by condition (room temperature) to the set temperature. Particularly, this was serious when the elongated recording head was used or when the members such as fins were attached to the recording apparatus.

Figure 28:
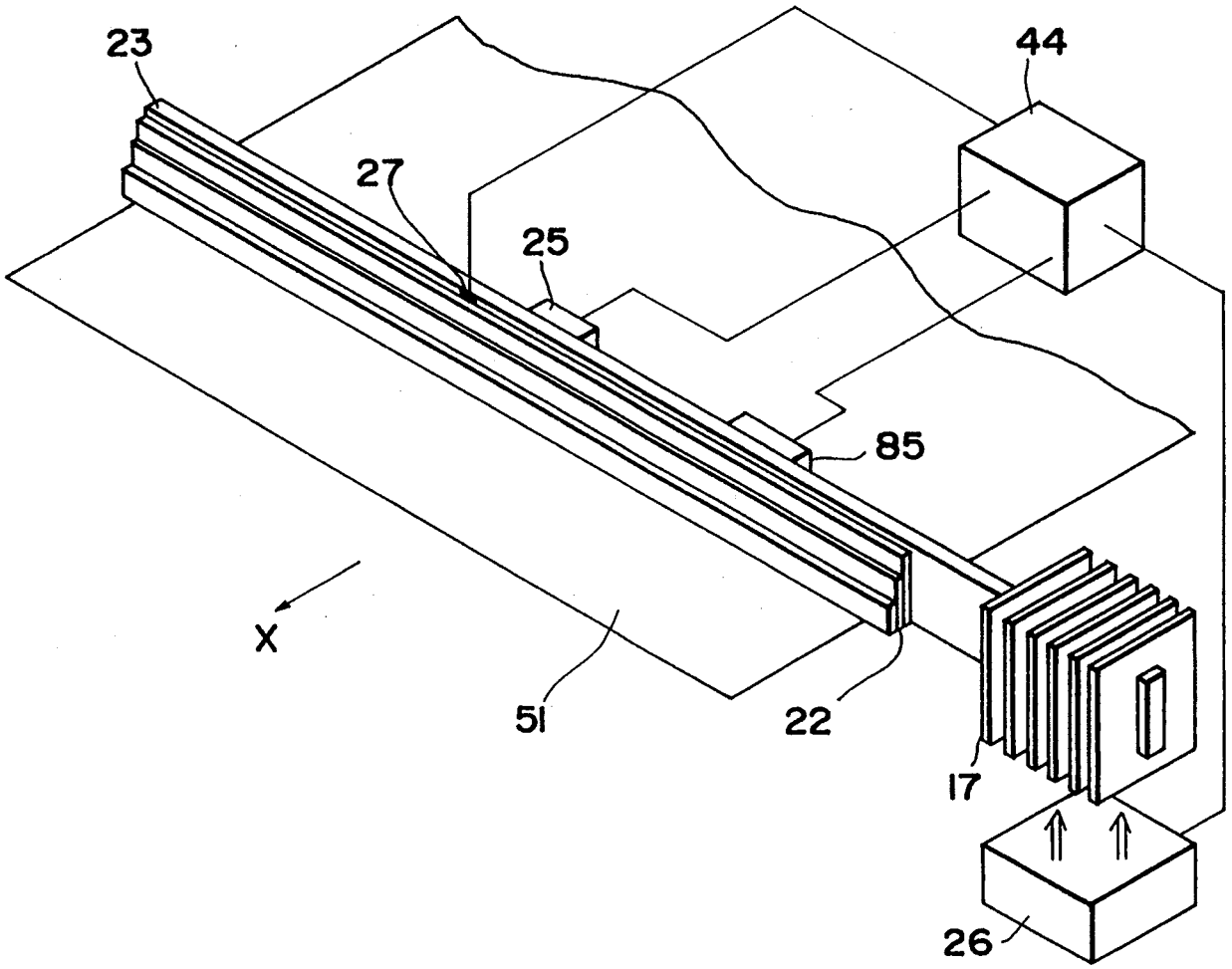
FIG. 28 is a perspective view of a main portion of an ink jet recording apparatus according to another embodiment of the present invention.

Next, an ink jet recording apparatus which can bring the temperature of the recording head up to the set temperature for a short time and then maintain the temperature of the recording head at the set temperature with accuracy will be explained with reference to FIG. 28.

As shown in FIG. 28, in this embodiment, in addition to the construction of the recording apparatus as mentioned above, a plurality (two in FIG. 28) of heaters for heating the heat pipe are provided. That is to say, on one side of the heat pipe 23, a heater 25 for heating the heat pipe and a heater 85 for the warm up are arranged. Since the other construction of the apparatus may be the same as any of those of the previously described embodiments, the explanation thereof will be omitted.

Next, the operation of the apparatus according to this embodiment will be explained.

When a record start switch (not shown) is turned ON, first of all, the temperature of a support portion side of the recording head 22 is detected by the temperature sensor 27. When the detected temperature is lower than a predetermined temperature (referred to as "set temperature" hereinafter) which must be kept during the recording operation (for example, 50° C. in the illustrated embodiment), the controller 44 activates the heater 25 and the warm-up heater 85 to heat the support portion of the recording head 22 through the heat pipe 23. In this case, the contacting area between the heat pipe 23 and the support portion acts as a condensation area where the operating fluid in the heat pipe 23 can be liquidized, and thus, the operating fluid vaporized by the heat from the heater 25, 85 can be uniformly dispersed through the condensation area and is condensed to uniformly discharge the latent heat, with the result that the support portion is subjected to the uniform heat flux, whereby the support portion is quickly and uniformly heated.

When the support portion reaches the set temperature, the adjustment of ink in the discharge opening is performed by an appropriate restoring means (not shown), and then the recording medium 51 is fed in a direction A by means of a feeding means (not shown). When the recording medium 51 reaches a position opposing the discharge opening, the thermal energy is applied to the ink in response to an image signal, thus discharging the ink from the discharge opening. The discharged ink is flying toward the recording medium 51 and is absorbed by the latter to form a desired image thereon. When the recording operations are continued, the recording head is heated by the residual thermal energy remaining in the recording head (among the applied thermal energy), and thus, the support portion is also heated. In this case, if the detected temperature from the temperature sensor 27 deviates from the set temperature by a tolerable value or more, the controller 44 activates the fan 26 to direct the air stream to the fins 17, thereby starting the heat discharge of the recording head 22 through the heat pipe 23. In this case, the contacting area between the heat pipe 23 and the support portion acts as a vaporization area for the operating liquid, with the result that the greater amount of operating liquid can be vaporized in a zone into which the greater heat flux from the support portion is flowing, and the lesser amount of operating liquid can be vaporized in a zone into which the lesser heat flux is flowing, and, thus, the operating liquid is vaporized in accordance with the heat values. Further, in a zone into which no heat flux flowing, the operating fluid once vaporized is condensed there to discharge the latent heat for supplying the heat value. Since the vapor has no heat resistance and the transfer of heat can be effected instantaneously, the uniformalization of the interfacial temperature between the operating liquid in the vaporization area and the vapor can be effected instantaneously. Accordingly, even when the heat flux having the local dispersion is flowing into the support portion in response to the image signal, the temperature of the support portion can be maintained at substantially constant temperature value due to the temperature uniformalization action in the heat pipe 23. And, the heat amount remaining after the uniformalization is transferred to the fins 17 instantaneously, and is condensed there to generate the heat value. The generated heat value is transmitted to the air stream fed by the fan 26 through the fins 17 and thus is dispersed in the air.

The image recording operation is stably continued while the temperature of the support portion is maintained at substantially the set temperature as mentioned above, by properly activating or deactivating the fan 26 through the controller 44 on the basis of the detected temperature from the temperature sensor 27.

As mentioned above, by mounting the heat pipe on the recording head and by heating or cooling the recording head through the heat pipe on the basis of the temperature of the recording head, it is possible to heat or cool the elongated recording head uniformly, and, thus, to control the temperature of the elongated recording head uniformly and stably. Consequently, the ink discharge condition is considerably stabilized, thus greatly improving the stability of the image. Further, with the arrangement as this embodiment, since the fins and fan are disposed out of the recording area of the recording head, the strong air stream from the fan can be prevented from flowing into the recording area, thus preventing the disturbance of the flying ink, thereby improving the stability of the image.

Figure 29:
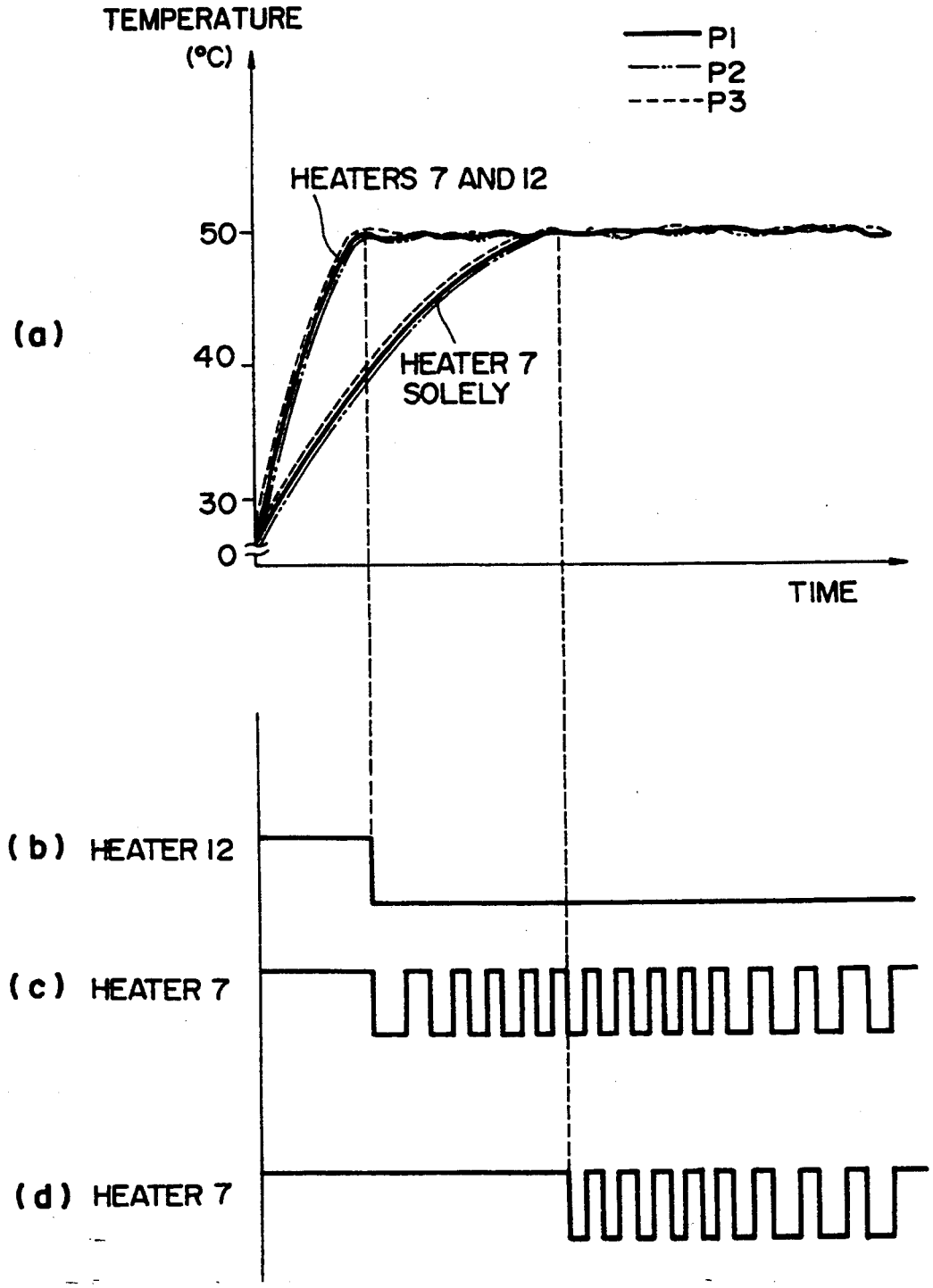
FIG. 29 is graphs showing comparison results between the case where both of heaters 25, 85 of the embodiment of FIG. 28 are used and the case where only the heater 25 is used.

Now, the measured data of the change in temperature along the longitudinal length of the support portion constituting the recording head 22, measured at a plurality of different points is shown in FIG. 29.

In FIG. 29, the abscissa indicates a time elapsed after the heater 25 or 85 is turned ON, and the ordinate indicates a temperature value of the contacting area between the heat pipe 23 and the support portion. The temperatures are detected at three points, a first of which is a position ($P_1$) directly below the heater 25, a second of which is a position ($P_2$) spaced apart from the position ($P_1$) by 10 cm in the longitudinal direction, and a third of which is a position ($P_3$) spaced apart from the position ($P_1$) by 20 cm in the longitudinal direction. The set temperature is selected to 50° C., and the detected temperature at the first position is given to the controller 44 as a controlling temperature. Before the warm-up, the temperature of the support portion corresponds to the room temperature of 28° C.

When both of the heaters 25 and 85 are used, at the beginning of the warm-up, since the detected temperature from the temperature sensor 27 is 28° C. and is lower than the set temperature (50° C.), the controller 44 activates the heaters 25 and 85 until the set temperature (50° C.) is reached (thereafter, these heaters are turned OFF), and then controls the heater 25 solely to bring the detected temperature to 50° C.

Even when the heater 25 is used solely, the control regarding the heater 25 is the same as the previous case, except that the control regarding the heater 85 is omitted (i.e., the heater 85 is always turned OFF or there is no heater 85).

As apparent from FIG. 29, the warm-up time (time required to reach the set temperature of 50° C.) by using both of the heaters 25 and 85 is shorter than that by using the heater 25 solely by a half or less. However, in both cases, there is substantially no difference in temperature in the longitudinal direction of the support portion, and the temperature after the warm-up is maintained in a range of ±1° C. or less around the set temperature.

According to the illustrated embodiment, by heating and/or cooling the recording head through the heat pipe, it is possible to control the temperature of the elongated recording head uniformly, and, thus, to stabilize the ink discharge condition and improve the stability of the image. Since the heat pipe is used, it is no need to match the dimension of the heating means to the dimension of the recording head and/or to control the heating means by means of a plurality of heating means uniformly, thus reducing the cost and facilitating the assembling of the apparatus.

In addition, by providing the heating means capable of variably changing the heat amount applied to the recording head through the heat pipe, it is possible to shorten the time from the record demand to the recording permissible condition (i.e., warm-up time), thus omitting the high speed recording. Further, after the warm-up time has been elapsed, the heat value of the heating means can be reduced, thus saving the electric power for the heating and heat discharging.

In addition, when the heat pipes are integrally fixed through the connecting member, by permitting the heat transfer between the recording heads and by changing-over the heat amount at the warm-up operation and at the recording operation by means of the heating means, it is possible to shorten the warm-up time (required to bring the recording head from the room temperature to the set temperature) of each recording head and to control the temperatures of the recording heads at a constant temperature value uniformly during the recording operation. As a result, the following advantages are obtained.

That is to say, it is possible to cool the plural recording heads by a single cooling means, thus making the recording system small-sized and reducing the cost of the apparatus.

Further, the electric power for the heating and heat discharging can be minimized.

In addition, the maximum electric power required for the heat discharging can be reduced, thus making the cooling means small-sized.

Further, it is possible to reduce the distance between the recording heads due to the use of a single small-sized cooling means, thus improving the registration operation.

Furthermore, it is possible to shorten the time required from the image demmand to the image output, and to record the stable image.

The present invention provides excellent advantages by adopting an ink jet recording apparatuses, particularly, bubble jet recording heads and recording apparatuses proposed by Canon co., Ltd (Japan).

The typical construction and principle thereof are preferably realized by referring the fundamental principle disclosed in U.S. Pat. Nos. 4,723,129 and 4,740,796. Although such apparatus can be applied to both of so-called "on-demand" type and "continuous" type, particularly, it is advantageously applicable to the on-demmand type, since, by applying at least one drive signal corresponding to the image information and capable of providing abrupt temperature increase exceeding the nucleate boiling point to the electric/thermal converters arranged in correspondence to the sheet and the liquid paths containing ink, the electric/thermal converters can generate the thermal energy to create the film boiling on the heat active surfaces of the recording heads, thus generating the bubble in the liquid (ink) corresponding, by one-to-one, to the drive signal. Due to the growth and vanishment of the bubble, the ink is discharged from the discharge opening to form at least one ink droplet. The drive signal is preferably formed as a pulse type, since, in this case, the growth and disappearance of the bubble are effected instantaneously and properly, whereby the ink is discharged with good response feature. The drive signal of pulse type may be ones described in U.S. Pat. Nos. 4,463,359 and 4,345,262. Incidentally, by adopting the conditions described in U.S. Pat. No. 4,313,124 disclosing the invention regarding the temperature increase ratio of the above-mentioned heat active surface, it is possible to perform the further excellent recording.

As the construction of the recording head, the present invention includes the construction wherein the heat acting portion is disposed in an arcuate area as disclosed in U.S. Pat. Nos. 4,558,333 and 4,459,600, as well as the constructions wherein the discharge openings, liquid paths and electric/thermal converters are combined (straight liquid paths or orthogonal liquid paths). In addition, the present invention can applicable to the construction wherein each discharge opening is constituted by a slit with which a plurality of electric/-thermal converters associated in common as disclosed in the Japanese Patent Laid-Open No. 59-123670 and the construction wherein openings for absorbing the pressure wave of the thermal energy are arranged in correspondence to the discharge openings as disclosed in the Japanese Patent Laid-Open No. 59-138461.

Further, as a recording head of full-line type having a length corresponding to a maximum width of a recording medium to be recorded, the construction wherein such length is attained by combining a plurality of recording heads as disclosed in the above patent specifications or a single recording head integrally formed may be adopted; the present invention can be applied to either of them with more excellent advantages.

In addition, the present invention is applicable to a removable recording head of tip type wherein, when mounted on the recording apparatus, electrical connection between it and the recording apparatus and the supply of ink from the recording apparatus can be permitted, or to a recording head of cartridge type wherein a cartridge is integrally formed with the head.

Further, it is preferable to add the head restoring means and/or preliminary assisting means to the recording head constituting the ink jet recording apparatus according to the present invention, since the advantages of the present invention become invincible. These means includes, for example, a capping means, cleaning means, pressurizing or absorbing means, and preliminary heating means constituted by the electrical/thermal converter, or other heating elements, or the combination thereof. Further, it is advantageous that a preliminary discharging mode for discharging ink independently of the ink discharge for the recording is performed, in order to achieve the stable recording operation.

Finally, regarding the recording modes of the recording apparatus, not only the recording mode using mainly the black ink, but also the multi-color recording mode or full-color recording mode using the combination of the plural recording heads can be used; also in this case, the present invention is advantageously applicable.

What is claimed is:

1. An ink jet recording apparatus in which recording can be effected by discharging ink from a plurality of parallelly disposed recording heads toward a predetermined area at a predetermined timing, said apparatus comprising:

said plurality of parallelly disposed recording heads;

a heat pipe with plural branch portions juxtaposed to corresponding said recording heads;

a common portion for connecting said branch portions together, said common portion being constituted by said heat pipe;

heating means for heating said branch portions and cooling means for cooling said branch portions, said heating means and said cooling means being provided on said common portion;

a plurality of temperature detecting means for detecting a temperature of said common portion; and activation control means for controlling the activation of said heating means and said cooling means on the basis of the temperature detected by said temperature detecting means, wherein said heat pipe has a flat shape and the following relationships are satisfied;

$5 \leqq d \leqq 20$ mm, $5 \leqq d_1 \leqq 20$ mm, $0 < d_3 \leqq 15$ mm, $d_1 \leqq d_3$, and $d > d_1$, where $d_1$ is a shorter side of said heat pipe, d is a distance between adjacent recording heads, and $d_3$ is a distance between a side of said heat pipe and an adjacent recording head.

2. An ink let recording apparatus according to claim 1, wherein said common portion comprises a second heat pipe integral with said first-mentioned heat pipe.

3. An ink jet recording apparatus according to claim 1, wherein said temperature detecting means are disposed at said common portion.

4. An ink jet recording apparatus in which recording is effected by discharging an ink from a plurality of recording heads toward a predetermined area of a recording medium at a predetermined timing, wherein:

each of said recording heads is provided with a heat exchanging means including a first heat exchanging section contacting with substantially the whole longitudinal area of one side of said recording head for performing heat exchange between it and said recording head and a second heat exchanging section spaced from and disposed outwardly of said recording head, at least said first heat exchanging section having an elongated rectangular cross-section; and when a shorter side of said elongated rectangular first heat exchanging section is $d_1$, a distance between said recording heads is d and a distance between a side surface of said first heat exchanging section of each heat exchanging means and an adjacent side surface of the corresponding recording head is $d_3$, the following relationships are satisfied;

$5 \leqq d \leqq 20$ mm, $5 \leqq d_1 \leqq 20$ mm, $0 \leqq d_1 \leqq 15$ mm, and $d > d_1$, wherein when said shorter side of said elongated first heat exchanging section is $d_1$ and a distance between a side surface of said first heat exchanging section of each heat exchanging means and an adjacent side surface of the corresponding recording head is $d_3$, the following relations ship is satisfied: $d_1 \leqq d_3$.

5. An ink jet recording apparatus according to claim 4, wherein each of said recording heads includes thermal energy generating means as discharge energy generators for generating thermal energy used to discharge ink, and ink is discharged from said recording heads by utilizing an abrupt in pressure in the ink due to the formation of a bubble created by said thermal energy.

6. An ink jet recording apparatus according to claim 4, wherein each of said recording heads further includes ink discharge openings disposed along the whole width of a recording medium.

7. An ink jet recording apparatus according to claim 4, wherein said temperature detecting means are disposed at a contacting area between said recording heads and branch portions.

8. An ink jet recording apparatus according to claim 4, wherein each of said temperature detecting means is disposed at a longitudinal central position of a corresponding said branch portions.

9. An ink jet recording apparatus according to claim 4, wherein said cooling means comprises a blower fan and fins for receiving air flow from said blower fan to dissipate heat in said heat pipes.

* * * * *

UNITED STATES PATENT AND TRADEMARK OFFICE

CERTIFICATE OF CORRECTION

PATENT NO. : 5,402,160

DATED : March 28, 1995

INVENTOR : HIDEJIRO KADOWAKI, ET AL.

It is certified that errors appear in the above-identified patent and that said Letters Patent is hereby corrected as shown below:

COLUMN 1

Line 33, "an" should be deleted; and

Line 63, "the" (first occurrence) should be deleted.

COLUMN 3

Line 22, "colling" should read --cooling--;

Line 45, "the head," should read --head, the--; and

Line 55, "R" should be deleted.

COLUMN 4

Line 38, "Publication" should read --publication--.

COLUMN 6

Line 61, "poriton" should read --portion--.

COLUMN 7

Line 53, "colling" should read --cooling--; and

Line 67, "head a" should read --head, a--.

COLUMN 9

Line 18, "mesns" should read --means--.

UNITED STATES PATENT AND TRADEMARK OFFICE

CERTIFICATE OF CORRECTION

PATENT NO. : 5,402,160

DATED : March 28, 1995

INVENTOR : HIDEJIRO KADOWAKI, ET AL.

It is certified that errors appear in the above-identified patent and that said Letters Patent is hereby corrected as shown below:

COLUMN 10

Line 57, "al;" should read --al.;--.

COLUMN 11

Line 10, "constructural" should read --constructional--.

COLUMN 12

Line 22, "Fins are attached to a" should be deleted;

Line 23, "bottom surface of the heat discharging block 24." should be deleted; and Line 67, "about." should read --thereabout.--.

COLUMN 13

Line 8, "driver, 41," should read --driver 41,--;

Line 35, "temperature" should read --temperatures--; and

Line 38, "ture" should read --tures--.

COLUMN 15

Line 20, "sensor 27a," should read --sensors 27a,--; and

Line 22, "ON" should read --OFF--.

UNITED STATES PATENT AND TRADEMARK OFFICE

CERTIFICATE OF CORRECTION

PATENT NO. : 5,402,160

DATED : March 28, 1995

INVENTOR : HIDEJIRO KADOWAKI, ET AL.

It is certified that errors appear in the above-identified patent and that said Letters Patent is hereby corrected as shown below:

COLUMN 16

Line 40, "blades 71" should read --blades 71a, 71b, 71c, 71d--; and

Line 45, "a" (second occurrence) should read --an--.

COLUMN 17

Line 43, "epxlained" should read --explained--.

COLUMN 18

Line 23, "ink" should read --inks--.

COLUMN 19

Line 10, "aluminium;" should read --aluminum;-- and "aluminium" should read --aluminum--; and Line 13, "aluminium" should read --aluminum--.

COLUMN 20

Line 26, "aluminium," should read --aluminum,--.

COLUMN 22

Line 30, "surface" should read --surfaces--;

Line 31, "a" should be deleted;

Line 34, "means 17" should read --means 25--; and

Line 47, "units 20A-20D" should read --unit 20A-20D--.

UNITED STATES PATENT AND TRADEMARK OFFICE

CERTIFICATE OF CORRECTION

PATENT NO. : 5,402,160

DATED : March 28, 1995

INVENTOR : HIDEJIRO KADOWAKI, ET AL.

It is certified that errors appear in the above-identified patent and that said Letters Patent is hereby corrected as shown below:

COLUMN 25

Line 22, "relation;" should read --relation:--.

COLUMN 27

Line 39, "heads" should read --heads,-- and "example" should read --example,--.

COLUMN 28

Line 54, "meet" should read --to meet--;

Line 63, "apparatus," should read --apparatus--; and

Line 67, "an" should read --a--.

COLUMN 29

Line 44, "on the" should read --an--; and

Line 51, "had" should read --bad--.

COLUMN 30

Line 26, "the" should be deleted; and

Line 31, "is flying" should read --flies--.

COLUMN 32

Line 11, "means the" should read --means and the--; and

Line 20, "utilized." should read --be utilized.--.

UNITED STATES PATENT AND TRADEMARK OFFICE

CERTIFICATE OF CORRECTION

PATENT NO. : 5,402,160

DATED : March 28, 1995

INVENTOR : HIDEJIRO KADOWAKI, ET AL.

It is certified that errors appear in the above-identified patent and that said Letters Patent is hereby corrected as shown below:

COLUMN 33

Line 1, "object" should read --the object--;

Line 23, "warm up" should read --warm-up--;

Line 43, "heater 25, 85" should read --heaters 25, 85--; and

Line 58, "is flying" should read --flies--.

COLUMN 35

Line 28, "it" should read --there--.

COLUMN 37

Line 46, "satisfied;" should read --satisfied:--;

Line 50, "$0 < d_3 \leq 15$ mm," should read --$0 \leq d_3 \leq 15$ mm,--; and

Line 57, "let" should read --jet--.

COLUMN 38

Line 24, "satisfied;" should read --satisfied:--;

Line 27, "$0 \leq d_1 \leq 15$ mm," should read --$0 \leq d_3 \leq 15$ mm,--;

Line 34, "relations ship" should read --relationship--;

Line 41, "abrupt" should read --abrupt change--; and

UNITED STATES PATENT AND TRADEMARK OFFICE

CERTIFICATE OF CORRECTION

PATENT NO. : 5,402,160

DATED : March 28, 1995

INVENTOR : HIDEJIRO KADOWAKI, ET AL.

It is certified that errors appear in the above-identified patent and that said Letters Patent is hereby corrected as shown below:

COLUMN 38, Cont'd.

Line 54, "portions." should read --portion.--.

DRAWING

Sheet 5, Fig. 7, "CONTROLL" should read --CONTROL--.

Figure 9:
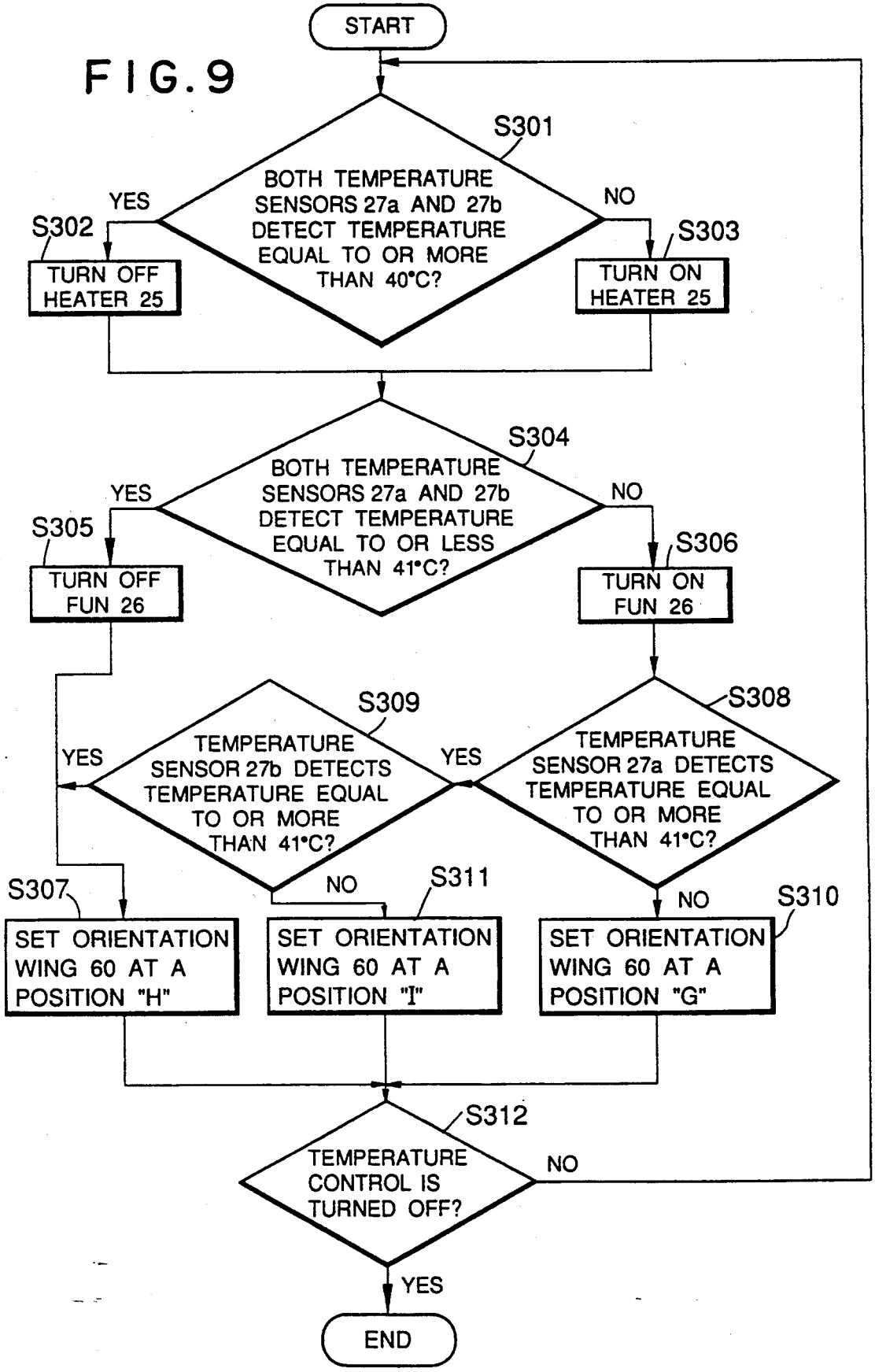
FIG. 9 is a flow chart for performing the temperature control of the recording apparatus of FIG. 8.

Sheet 7, Fig. 9, "FUN 26" should read --FAN 26-- (both occurrences).

Signed and Sealed this

Twenty-first Day of November, 1995

Bruce Lehman

*Attest:*

BRUCE LEHMAN

*Attesting Officer*

*Commissioner of Patents and Trademarks*